US006152014A

United States Patent [19]

Willimczik

[11] Patent Number: 6,152,014

[45] Date of Patent: Nov. 28, 2000

[54] ROTARY PISTON MACHINES

[76] Inventor: Wolfhart Willimczik, 1406 63rd St. West, Bradenton, Fla. 34209

[21] Appl. No.: 08/883,729

[22] Filed: Jun. 27, 1997

Related U.S. Application Data

[63] Continuation-in-part of application No. 08/394,202, Feb. 24, 1995, abandoned, which is a continuation of application No. 08/063,732, May 20, 1993, abandoned, which is a continuation of application No. 07/493,901, Mar. 15, 1990, abandoned.

[30] Foreign Application Priority Data

Mar. 17, 1989 [DE] Germany ..... 39 08 744

[51] Int. Cl.[7] ..... F01B 3/00

[52] U.S. Cl. ..... 91/499; 417/269; 92/172

[58] Field of Search ..... 99/499, 500; 92/129, 92/172; 417/269

[56] References Cited

U.S. PATENT DOCUMENTS

| | | | |
|---|---|---|---|
| 3,434,429 | 3/1969 | Goodwin | 91/500 |
| 3,534,663 | 10/1970 | Doyle | 91/500 |
| 3,659,502 | 5/1972 | Friedman | 92/84 |
| 3,795,179 | 3/1974 | Picker | 91/500 |
| 4,095,427 | 6/1978 | Stropkay | 92/84 |
| 4,361,077 | 11/1982 | Mills | 91/500 |
| 4,776,257 | 10/1988 | Hansen | 92/12.2 |
| 5,070,765 | 12/1991 | Parsons | 417/269 |

*Primary Examiner*—Charles G. Freay

[57] ABSTRACT

This invention relates to rotary piston machines with a positive displacement principle, pressure-tight work chambers and a strong piston actuating mechanism without power transmitting bearings. A piston rotor is rotationally coupled via its pistons or plungers, which reciprocatingly move in the cylinders of a cylinder rotor. Both axial and radial machines are included having a short stroke motion, but only in a co-rotating system. No oscillating mass power exists. This new piston actuating concept is applicable for all machines having at least one rotating pair of piston and cylinder. On top of the wide variety is an axial piston machine with a self-aligning pulling piston actuating mechanism and a quasi complete hydrostatic pressure balance of all movable parts including an outgoing shaft. This invention allows the building of machines, such as water hydraulic motors, pumps, vacuum pumps, and dry running or water-sealed compressors etc, for any reasonable parameter, such as high pressure, high volume, and any reasonable speed without necessarily lubricating said machines. Practice confirms that such machines are the State-of-the-Art in this field. Combinations of two or more machines in one housing, and with one shaft only, are possible also, for instance a motor and a pump for energy recovery systems etc. All these machines are not only able to work completely oil-free and are environmentally friendly, but they also operate at the highest performance combined with a high efficiency.

5 Claims, 20 Drawing Sheets

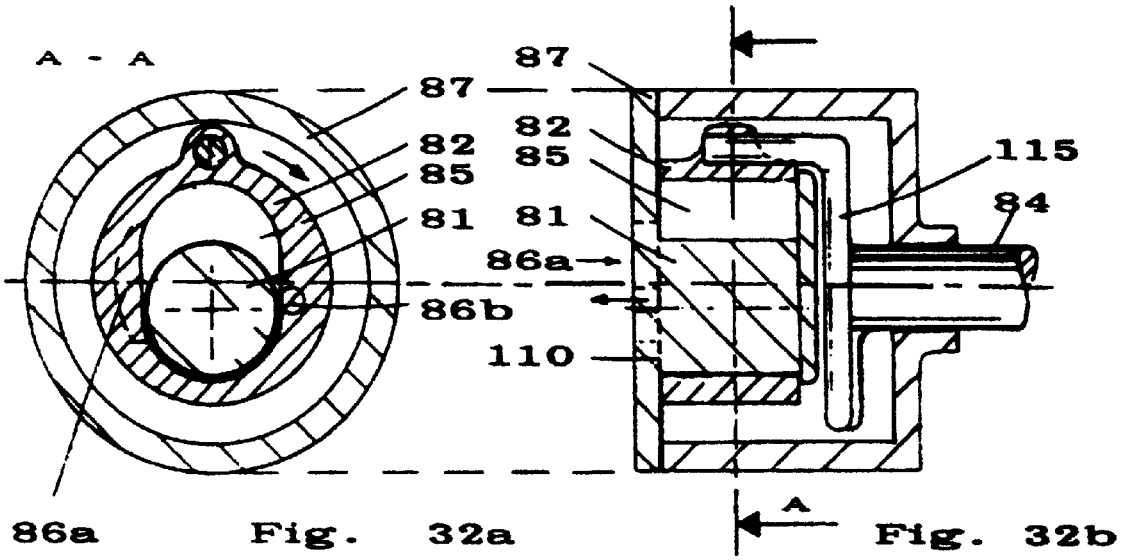
Fig. 32a
Fig. 32b
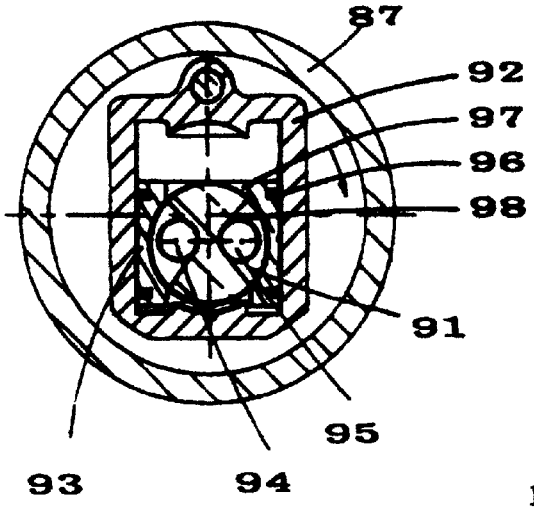
Fig. 33

ROTARY PISTON MACHINES

This application is a continuation-in-part of application Ser. No. 08/394,202, filed Feb. 24, 1995, now abandoned. Which is a continuation of application Ser. No. 08/063,732, filed May 20, 1993, now abandoned. Which is a continuation of application Ser. No. 07/493,901, filed Mar. 15, 1990, now abandoned.

CROSS-REFERENCE TO RELATED APPLICATIONS

This application is related to a second continuation-in-part of application, "Kinematic assembly for wear-resistant transmission of forces upon conversion of motions, especially a stroke motion into a rotational motion," U.S. Ser. No. 07/493,901, filed Mar. 15, 1990, abandoned, and is related to the first continuation-in-part application, "Rotary piston machine with a wear-resistant driving mechanism," Ser. No. 07/832,381, filed on Feb. 7, 1992 in the U.S. Patent and Trademark Office, now U.S. Pat. No. 5,249,506. The original application, "Kolbenmaschine mit formschlüssigen Kraftübertragungsteilen" or "Piston machine with desmodromically guided parts" No. P 39 08 744.1, was filed Mar. 17, 1989 in the German Patent Office.

BACKGROUND OF THE INVENTION

This invention relates generally to a rotary assembly device that converts fluid or gas power directly into rotating mechanical force, and vice versa, without any corotating bearings in the rotating power train or actuating mechanism; and particularly, to rotary piston machines with bearingless, direct or desmodromically guided power transmission parts, and hydrostatic pressure compensated or balanced stressless and frictionless sliding parts. Each cooperating cylinder and piston pair forms a pressure tight work chamber. Both piston and cylinder are moved along different, but closely neighboring orbits, wherein the maximal distance between said both co-rotating parts is only a fraction of a diameter of the orbits. This enables a short stroke motion between the piston and the cylinder in a co-rotating body-bounded-system. Such a reciprocative movement between a piston and cylinder caused no oscillating mass power, because it exists only in a co-rotating system. The shortness (compared with a diameter of an orbit) of the stroke motion is not a disadvantage. Pistons are directly attached to a piston carrier without bearings. Pistons, piston rods, and a piston carrier are the main parts of a piston rotor. The cylinders are integrated in a compact contiguous cylinder rotor and are interengaged by the pistons. Both rotors are rotational coupled thereof. The configuration in space of both rotor axes is basically arbitrary, but must lie within all orbits. The direction in space of the stroke motion is freely selectable. Consequently, the axial and radial machines are only corner stones in this field.

This kind of positive displacement machine is characterized by the absence of any bearing in the power train or actuating mechanism to transmit the piston force. Consequently, this principle is able to run absolutely oil-free as a pump or as a water hydraulic motor. It can also generate oil-free and highly compressed air. It operates as a compressor or vacuum pump, or a combination thereof, whereby water can be used as a system fluid for sealing and cooling.

An additional hydrostatic pressure balancing of the movable parts makes sliding between the sliding parts stressless and frictionless. Consequently, this principle is able to work, such as in the aforementioned machines, not only oil-free, but also at high pressure (over 100 bar), with high performances and with high efficiency. For instance, it can operate as a water hydraulic motor or a high pressure water pump, whereby other parameters, like delivery, are practically unlimited.

DISCRIPTION OF THE PRIOR ART

An earlier invention, No. P 39 08 744.1, filed on Mar. 17, 1989 in the German Patent Office, describes a new design for a power/torque transmission, and in particular, for rotary piston machines.

A piston and a cooperating cylinder rotate in two slightly different and near-circularly orbits. This difference generates an oscillation between each piston and cylinder pairs in a co-rotating, body-bounded system. One component of this oscillation, the component along the cylinder axis, creates a useful short-stroke motion in a rotating, body-bounded system. According to cylindrical coordinates along the stroke motion a component remains, which is perpendicular to the first one. This unwanted component is first minimized and then compensated or absorbed without using bearings. This was the basic task.

The pistons, the piston rods, and the piston carrier with a drive shaft are combined to form a piston rotor without the use of bearings between the pistons and the drive shaft. The piston rotor is most rigidly fixed on a drive shaft. The pistons interengage the cylinders. Each cylinder is integrated in a compact cylinder drum or cylinder rotor, which has at least one cylinder. The cylinder rotor slides with one annular surface, including the open ends or control openings of the cylinders, which is now called the control surface of the cylinder rotor, upon an always stationary control surface. The control surface can be in any given rotational symmetrical shape, preferably even, conical and cylindrical. The angle between the drive shaft and the cylinder symmetry axis is unlimited variable, that is, any angle between 0° and 360° is possible. Consequently, axial (small angles) and radial (90°) machines are included as corner stones in this field.

A bearing-free actuating mechanism has been created for basically all rotary piston machines. This invention has eliminated all ordinary co-rotating bearings, exposed to the media within the machine. This has been the scope of the original invention. Such piston principle is pressure tight. Therefore, these facts would make the whole scale of rotary piston machines simpler and able to run oil-free, if there would not be other obstacles, such as too much stress on flexible power transmitting parts and too much friction on sliding parts, caused by a high pressure within the machine. The well-known problem of excessive contact pressure appears at a high pressure. Consequently, a nonlubricating fluid, like water, would generate too much wear, but today's needs for oil-free machines are increasing. Examples of such machines include compressors, non-flammable hydraulic systems, in particular, a water hydraulic motor.

The new contiguous power train would not only be applicable for every well-known machine, but also for every unknown rotary piston machine, because the idea is based on fundamental physical facts, which has never been considered in regard to rotary piston machines. These facts are also the reason for any number of examples.

SUMMARY OF THE INVENTION

The present invention relates to a rotary piston machine with direct or desmodromically guided parts in the piston actuating mechanism, that is, a bearing-free power train, and solves the aforementioned problems. This invention creates a very strong piston actuating mechanism without bearings. This invention also reduces friction significantly by a quasi complete hydrostatic pressure compensation of all sliding parts at high pressure. Therefore, this invention creates very powerful positive displacement machines, which can operate at high volume, at high pressure, with high performance with high efficiency and after all without lubrication.

The above and further objectives of the invention will become obvious to those skilled in the art and in theoretical mechanics upon reading the following description.

The main parts of the working mechanism of this machine are a piston rotor and a cylinder rotor, which are engaged by the pistons in the cylinders.

The piston rotor has a circularly arranged formation of pistons, which can be exposed radial, axial or in any direction. The pistons can be shaped cylindrically as a plunger piston or as a classical piston, or they are spherically shaped. The pistons are always pressure-tight members without any passages. There are never co-rotating bearings in the piston actuating mechanism to transmit piston forces. The cylinder rotor always has a corresponding formation of cylinders.

To create a pressure-tight working space in the cylinder, there must always be a sealing edge between cylinder and piston. Said edge wipes sealingly along either an inner cylinder wall or an exterior cylinder wall of a plunger piston. In the last case, the narrowest end of a tapered cylinder can provide by itself a flexible sealing edge. However, it is mostly used an individual sealing element between piston and cylinder providing a sealing edge or sealing lip.

The cylinders are integrated in a cylinder rotor with an uninterrupted annular control surface containing only their own control openings of the cylinders.

Gain of this invention is to apply the proven classical control mechanism wherein co-rotating control canals are guided sealingly over a stationary control plate with respective control canals. Both interact together to control the flow in and out of said cylinder.

Said mechanism may include any number of pistons, piston seals, piston rods, piston carriers having mostly a shaft and sometimes another piston rotor and at least one cylinder rotor with the same number of cylinders. All these movable parts of the mechanism can be arranged lateral floating or shiftable, or they are respectively angular movable arranged, to solve the problem caused by the inclination and/or eccentricity between both rotor axes.

The theoretical base for this invention was found in the characteristic of the cosine function around 0° which describes the ratio between a useful work chamber volume and the increase of unwanted lateral movements or disparities in dependence of the inclination angle or distance between both rotor axis. The changing of the cosine function around 0° is insignificant. And therefore, the displacements are insignificant as well (only a small fraction of the entire stroke length), that bearings are not more necessary, if only small angles and small eccentricities are applied.

The desirable result is, that there are only lateral shiftable elements in the actuating mechanism instead of bearings. This allows the use of strong piston connecting members to build a very strong (perhaps the strongest of all) piston actuating mechanisms.

The idea was to equalize the disparities without using bearings; or in other words, to move the piston seal along the cylinder wall in spite of the fact that the piston attempts to leave the cylinder center-line and moves on a deformed arc instead. The solution was as follows: every circular or arched movement can be decomposed into two linear movements, each being perpendicular to one another. In case of an exact circular movement, the amplitudes are equal for both components.

But in this case, the circular or curved motion along said cylinder center-line is only an arched oscillation within 10° (+/−5°), instead of 360°. One component of the movement is only about 1% of the other. A short arc is almost a straight line. The physics shows that every lateral disparity comes into being by the cosine function (or 1−cos x) of the inclination angle and the distance between both axes respectively. The cosine function has only very small changes around 0°, for instance between 0° and 5° only about as much change occurs as between 10° and 11°; that is, between 5° and 0° as much as for only 1° more at an angle around 11° (cos 5°−cos 0°=cos 11.2°−cos 10°; 0.996−1=0.9809−0.9848). (Ordinary axial piston machines operate at higher angles and generate a lot of disparities, which must be absorbed by bearings.) In other words, it must be possible to create a volume for a displacement machine almost without lateral disparities between pistons and cylinders if only small angles or distances between the rotor axes are used. These inventions are technical applications of the characteristic of the cosine function around 0°. Therefore, the remaining disparities or deflections crosswise to the stroke motion can be easily eliminated without using bearings. The deflections and the necessary shifts are only in the order of magnitude of 1% of a relative short stroke length. The normal clearance in a thread or the clearance between other engaged parts, for instance between the pistons and the piston sealing elements lateral to the stroke motion, or the natural or a priori elasticity of piston rods, even the low elasticity of ordinary screws in steel, provide enough space or movement to absorb the remaining deviations or deflections perpendicular to the stroke motion.

Looking at an axial machine and according to cylindrical coordinates along the cylinder rotor axis, the deflections between the pistons and the cylinders can be decomposed in a first radial component and in a second circumferential or angular component. First, the radial distance between two opposite pistons in respect to the concerning cylinders is not always exactly the same within one rotation. The difference is the radial component of the deviations. Second, the pistons and the cylinders are normally exactly circularly arranged, having a constant angular distance between the two neighboring elements. This angle varies in respect to the other rotor throughout one revolution, which is caused by the inclination between both rotors.

A slanted projection of any angle shows another angle. An angle is basically covariant in regard to any transformation of coordinates. There is only one exception, an angle of 180°, which is actually a strait line. Our experience shows that a shadow of a strait line on a plain is always a strait line again. This is the reason that between two diametrical pistons or cylinders a minimum of the lateral disparities exists, only the radial component of the disparities, not in circumference direction.

Therefore, such a two-cylinder machine has certain advantages, because the radial shifts can be eliminated also by using non-straight-sided cylinders, which are arched so, that the arched path of said two diametrical pistons lie exactly in the arched cylinder center-line and theoretically no disparities occur, presupposed the point of intersection of both rotor axis is the center of the arcs. When using straight-sided cylinders, all lateral disparities have a minimum, if said point of intersection lies in a plane defined by the middle-points of all stroke motions.

A greater inclination-angle for straight-sided cylinders would require the use of real elastic material or other solutions, but a greater angle for a greater volume is not necessary, because the volume of a cylinder increases with the square of the radius, and the said inclination angle changes only the length of the stroke motion. Therefore, it is more effective to change the diameters of the pistons and the cylinders respectively for a greater volume of the machine, which is actually a simple photographic enlargement of the machine. Any volume and delivery are possible.

The physics delivers a theory that the cylinder rotor doesn't need self-guiding parts like a shaft, because it is guided by the pistons and piston seals respectively. This seems to be a contradiction because all piston seals can be loose around the piston rod. Actually, not all piston seals guide the cylinder rotor simultaneously. The theory of this guiding mechanism is complicated and can not be described here in full. One important result is, that, if all concerning parts are suitably arranged, all lateral movable parts find the best position in respect to the lateral deviations or shifts automatically for a minimum of stress according to a discovered law of physics what can be called a "self-organizing stress-relieving mechanism". That means, a lateral movable part moves preferably only in the non-active phase, ergo without longitudinal forces. (Or for instance, if one part is jammed, and does not more move laterally, the working process is not disturbed.) For a proper function of said process is the cylinder rotor free floating arranged, ergo without a shaft.

A proper construction creates a smooth rotation of all movable parts even at high performances. Practice has shown that indeed the piston rotor starts to move on a polygon shaped distorted circle with a number of corners corresponding to the number of pistons, instead of an exact circle, if all lateral mobilities together are unnecessarily too great.

Another problem is the wear problem at high pressure and high volume and with non-lubricating fluids, such as water. This problem is solved by a quasi complete pressure release of all movable parts and, in particular, between sliding parts. The physics shows the way. Friction, and consequently wear are dependable on sliding speed, material conditions, and it increases linearly with the contact pressure. A high contact pressure must be removed or minimized by pressure balancing every single movable part; that is, the elimination of every burdensome contact pressure between every touching sliding components, or in other words, by making the sum of all attached force vectors on every movable part equal zero in order to achieve a complete force equalization or balance. The balance is ideal, if a necessary sealing pressure remains only; and consequently, both sliding partners slide frictionless.

All movable parts rotate without an oscillating movement in space. These rotating parts include a single-pieced or fluidly summarized cylinder rotor and a fluidly summarized piston rotor with a drive shaft in most cases. (When two or more formations of pistons and cylinders are being used for different tasks in the same housing, for example, a motor and a pump, an outgoing shaft with a shaft seal are not necessary.)

The physically logical guide line, which can solve this prementioned problem, is as follows: to eliminate wear by high pressure, friction must be eliminated. To eliminate friction, contact pressure must be eliminated. To eliminate contact pressure, forces between sliding parts must be eliminated. To eliminate forces, a force equalization must be achieved for every movable part. The deciding parameters are the hydraulic forces caused by fluid or gas pressure. There are basically three pressure levels, namely: the input level, the output level, and the pressure level in the housing of the machine, which can be variably selected to help solve the problem. Another variable parameter is the size of each sealed pressurized area, having a certain pressure level, and particularly, two areas with an opposite direction of the force vectors. On both rotors, there are, or will be created, different sealed pressurized areas or pressure cushions with opposite directions of the force vectors in order to balance both movable parts. The sum of all forces can be made almost equal to zero for both rotors by using a suitable configuration and likewise, for axial and radial machines. In addition, the rotational connection between both rotors can be made substantially torque free.

To regain only frictionless sliding parts a hydrostatic pressure balance of all movable parts is necessary:

Balancing of the Piston Rotor:

The piston rods can basically push, pull, or both with different selectable amounts during one revolution, which depends on which side of the pistons is at higher pressure. Ordinary piston actuating mechanisms are pushing mechanisms, because they push a piston against a working pressure in a cylinder. But this piston actuating mechanism can push, pull or both within one revolution, which depends on the different possible pressure levels in the housing, in the cylinders and in the control canals of the stationary control surface. Three different versions are possible, only pushing piston rods, only pulling piston rods, and pulling/pushing piston rods. The last version is the most general, whereby the piston force reverses its direction during one revolution, for instance, when the piston rods have first to pull against a certain pressure in the housing and then to push against a higher pressure in the cylinder during the other half of one revolution. The piston rods have only to push, if the working pressure is only in the cylinders, a well known condition like an ordinary piston pump. If there is the highest pressure in the housing behind the pistons, the piston rods experience only a tractive force and have only to pull. The basic structure of the piston actuating mechanism can be for all three versions the same, if all piston connecting members are able to transmit longitudinal forces in both contrary directions. A rod can basically pull and push, if it is thick and stable enough like an ordinary piston rod. But there is an exception for the "only pulling" piston actuating mechanism. Here are also usable piston connecting members like a rope, which are able to transmit only a high tractive force. Of course are the pistons still pushed in the cylinders, but without any load, emptying the cylinders only in a quasi isobar process. Such insignificant small pushing force can take over a compression spring holding the piston sealing element in position. The pulling piston actuating mechanism has a great advantage compared with the others, because pulling connecting members are self-aligned to the tractive force vector like a pulling rope. In contrast, the pushing connecting members have an unwanted contrary tendency.

In the case of a radial piston machine, there are no axial forces.

The radial forces can be balanced by two or more neighboring circles of circularly arranged cylinders in the same cylinder rotor. Both systems work separately against the same pressure level, but are rotated 180° against each other. Consequently, the radial forces are counterbalanced, regardless of whether the piston rods are pulling or pushing.

In the case of an axial piston machine different and better options are possible for an axial balance of the piston rotor, including the outgoing drive shaft. (In a radial direction are no forces to balance.) Presupposing the axial machine with piston rods works as a high pressure water pump, the best or first option is as follows: in the housing is the highest pressure level, generally the delivery or working pressure, then the pistons experience a pressure difference only during about one half of one revolution, only over one half of the stationary control plane, that is, a semi-circle on the suction or low pressure half with a kidney-shaped low pressure canal, that is, a stationary working side or on a time base an active phase whereby the pistons have to work against a pressure difference. Consequently, the piston sealing elements have to be pressure tight for only one half of one revolution, and only in one direction, like a simple wiper. The compression stage in the cylinder is eliminated. Instead, the pistons have to pull during the intake stage against the pressure in the pressurized housing on the backside of the pistons adjacent to the piston rods.

Now, the piston rotor and the drive shaft together can be balanced in a simple manner, because the pressure in the housing pushed the pistons and the sealed outgoing shaft in two opposite directions. The sealed area of the shaft seal must be equal to the sum of all cross sections of the pistons which are just or momentarily over the working side or low pressure half. The axial force vectors on the pistons and on the shaft are oppositely directed. The pressurized areas must be equiareal, that is, must have the same area content. In this content, the sealed shaft can be considered as a larger additional piston pulling or pushing the piston rotor in a opposite direction as the real pistons. This balance can be achieved in any case, because the diameter of the shaft seal can be made in any larger size as the diameter of the shaft itself.

The remaining pulsations are minimized by using a suitable number of pistons combined with suitable control periods. It is to be noted that this new working process has a useful side effect. The compression stage in the cylinder, usually following after a suction stage, is practically eliminated; in fact, it has a quasi zero pressure difference, because, during this stage, the same pressure is on both sides of a piston. Fluid will only be ejected out of the cylinder. This is a significant advantage, because all of the well-known disadvantages of a compression stage are eliminated as well. For example, no piston machine is able to pump a fluid-gas mixture to high pressure due to pressure shock waves in the cylinder during the compression stage. This is the reason why the entire air conditioning industry is still using compressors instead of simpler and smaller fluid-pumps. The axial machine can be balanced in absence of a shaft seal also. (If there is a shaft with rotors on both axial ends, there is no need for a balance because it is a priori balanced). The pistons, just being momentarily over the suction side, can pull and, over the pressure side, push the same amount of force, but in opposite directions, so that the sum of all force vectors is equal to zero. In this case both halves, the high and the low pressure half respectively, are sealed and are working sides. The pistons and the respective sealing elements are pressure tight in both directions. In the housing it is at about half delivery pressure.

A combination of both options is possible too, for example, for large machines with piston cross-sections much wider than the cross-section of a sealed drive shaft. The pressure in the housing will be a little greater than one-half the delivery pressure, and the piston rods pull on the suction side more than the piston rods push on the pressure side. (In this content the sealed shaft can be considered an additional piston.) To this end, the sum of the axial force vectors will be zero.

In case of two axial opposite directed piston rotors or opposite directed piston rods on a piston carrier and two cylinder rotors in one housing, the axial balance is very simple; only the piston forces must be equalized. These balancing concepts work regardless of whether the sealing element wipes against the cylinder or against the piston plunger and regardless of the numbers or size of the pistons, pressure etc.

Balancing of the Cylinder Rotor:

One problem that appears at high pressure is that, an ordinary cylinder rotor would be pressed too hard against the control surface. More specifically, that occurs in a low pressure area of a control surface by a high pressure in the housing, and particularly in absence of any lubrication. Around any low pressure channel in the control plate there exists a low pressure area or cushion, which sucks the cylinder rotor against the control plate. Actually, the high pressure in the housing presses the cylinder rotor against the stationary control surface because the counter force is missing over a low pressure channel. The goal is to make the sum of all forces, which are attached on the cylinder rotor, almost zero, or in other words, to create certain high pressure cushions between both parts for a complete hydrostatic pressure compensation of the cylinder rotor against the stationary control plate.

The general method is always the same: create enough high pressure cushions between both control surfaces, preferably direct in a former low pressure zone, to release the cylinder rotor from burdensome contact pressure against the stationary control plate.

Such low pressure areas are the cross sections or bottoms of the cylinders being just connected via the openings to a low pressure channel. Therefore, the bottoms of the cylinders adjacent to the control plate must be partly closed and this closed portion underneath each cylinder must be sealed against low pressure in the rotating openings to retain a high pressure cushion around a low pressure area. Actually, it is a reduction of the size of the low pressure area and an enlargement of the size of the high pressure area between the cylinder rotor and the control surface in the stationary low pressure half until the cylinder rotor is in balance. This is, if the size of the low pressure area is equal to the sum of the cross sections of all non-pressurized cylinders. A pressurized cushion under a cylinder has no counterforce on the cylinder rotor, because this portion of the pressure field hangs on the pistons and finally on the piston rotor, but not on the cylinder rotor. Therefore, the pressure cushions can be adjusted to any specific construction, such as; axial or radial machines; pulling and/or pushing piston actuating mechanism; whether or not there is a pressurized housing; an outgoing shaft etc. Furthermore, this concept is applicable to any number of cylinders in any configuration and at any reasonable pressure. In the case, there is only one high pressure level, the delivery high pressure in the housing, then, two areas with the same area content, but with an opposite direction of the force vector, would be enough to balance or pressure compensate said rotor. In case of an axial piston machine, the cylinder rotor is a disk with two circular faces, an upper face and a lower face adjacent to the stationary control surface, called control surface of the cylinder rotor, containing the bottoms of the cylinders with its openings. The cylinder rotor rotates sealingly on the staying control surface. The hydrostatic pressure balance of the cylinder rotor should be describe in other words.

The cylinder rotor is axial in balance, if the amount of the forces on both faces are equal and the force vectors oppositely directed. When the housing is pressurized, the cylinder rotor experiences on every surface the same high pressure of the housing, except on two axially opposite areas, that is, a low pressure area around the low pressure control channel and the area content of all cylinders together which are just or momentarily connected to the low pressure channel.

Both areas must be equalized. That's basically all to achieve a balance.

For an equal area content, the radial extension of the sealed area around the low pressure canal must be less or narrower (The extension in peripheral direction is predetermined by the control mechanism and can not be changed without consequences, which are difficult to describe) than the diameter of the cylinders; and therefore, the cylinders must be partly closed. Therefore, the cylinder rotor is now in balance if the openings have a proper size in radial direction. This is mostly achieved when the openings have about half the area content of the cylinders. In practice, the force equalization is made so, that a small amount of contact pressure remains, to generate the necessary sealing pressure.

Practice has shown this method is so effective that, in spite of high pressure in the housing, the cylinder rotor can actually lift off from the control surface, if the openings are too small. Every desired sealing contact pressure is adjustable with the described balancing procedure of the cylinder rotor. It works regardless of all other parameters mainly the pressure.

On the pressure half, balance is not necessary if there is not a compression stage. If there is a compression stage and the piston rods are also pushing both sides, the low and high pressure halves, are working sides. On the high pressure half, the size of the sealing area or high pressure cushion must be different for a separate pressure balance of both halves. This can be done by changing the profile of the control surface. This profile can be different on both halves. Therefore, the low and the high pressure halves can be balanced separately.

These balance concepts are basically applicable for any configuration of a radial or axial piston machine, regardless of whether the control surface is a level plane, a cylinder jacket, a cone jacket, and the like.

In axial piston machines, the openings in the bottoms of the cylinders are more inside in most cases, because the unbalanced areas (exactly a differential small ring, if differencing in a axial direction) or the circumferential distance between the cylinder walls of the cylinder rotor are getting smaller toward the inside until the smallest distance between the cylinder walls, which is the best place for the control openings. Closing the same area content of the cylinder cross sections on the outside and on the inside of the cylinder rotor shows that it is more effective on the outside.

But it is advantageous for large compressors, if water is used as a sealing fluid, to make a second opening on the outside and use each opening for a separate inlet or the respective outlet, because the water is already preseparated from the air in the work chamber by radial forces.

Balancing of the Pistons in a Circumferential Direction:

This balancing procedure provides a quasi torque free connection between both rotors and a relief of the sealing elements between cylinders and pistons from lateral or transversal forces. There are three different reasons for such forces. The first reason, looking at the axial machines only, is related to the lateral displacements or disparities between the pistons and the cylinders due to the inclination between both rotor axes. Circularly arranged formations of pistons and cylinders, slantways to each other, appear elliptically distorted relative to each other. There are many ways to solve the problem due to the deviations between the orbits of the pistons and the cylinders perpendicular to the stroke motion. This concerns the following parts: the piston carrier, the attachment of the piston rod to the piston carrier, the piston rod, the piston, the piston seal, the cylinder, the attachment of the cylinder on the cylinder rotor, and the cylinder rotor. All these parts can be lateral floating arranged or the connections between them can be made lateral or angular loose or flexible, but always for small amplitudes or angles only. (Loosely connected or attached is defined as fixed in a longitudinal or force direction, and in a lateral or perpendicular direction loosely or with a certain clearance, for instance, like an attachment of a turbine blade.) Each item alone can basially solve this problem, at least to an inclination angle of 5°. In practice, several items may work together, even at greater angles.

The performance of this machine will not deteriorate because of the above. On the other hand, pumps for a low performance, in a range up to 10 bar only, can be made very simply in rubber and plastic parts. The piston and piston rod can be made together, in one piece, like a plastic screw with a head like a spherical sealing element, etc.

In practice, the following items have already proven to be effective for at least a water pressure of 100 bar: a radial clearance between piston and piston seal, a flexible piston seal, a loosely threaded piston rod in a piston carrier, and a flexible piston rod in steel or a fiber reinforced plastic screw. It should be noticed that the pulling piston rods have shown a great advantage compared with pushing rods or any ordinary classical pushing piston actuating mechanism, because they are self-aligning to the momentary tractive force vector. This is an essential part of this invention. (An other resulting advantage of pulling piston rods is the elimination of the compression stage in the cylinders.)

The second reason for a balance in a circumferential direction is related to the friction between the cylinder rotor and the stationary control surface. This is already solved by pressure balancing the cylinder rotor against the control surface. (The friction, caused directly by the fluid in the housing is insignificant.)

The third reason is caused by a transversal or lateral fluid pressure due to a deviation from the rotational symmetry of the sealing line between piston and cylinder. For instance, the use of a simple wiper in the cylinder combined with its inclined position relative to the cylinder causes an asymmetrical or non-rotational symmetrical pressure field around the cylinder wall. This generates lateral forces with a component in a peripheral direction and ergo a torque. The annular sealing line between piston and cylinder defines a surface in space, mostly a plane, a so called sealing plane. This surface can be defined by a surface-normal-vector. If this vector has the same direction as the cylinder axes, there are no lateral forces for the cylinder, which is realized by using spherical piston seals. By using simple wipers, the surface-normal-vector of the sealing plane is not in the axis of symmetry of the cylinder. Its movement describes a cone-shaped surface with the same inclination angle as between both rotor axes, but around the axis of symmetry of the cylinder. The component in peripheral direction swings in a sinusoidal variation. This usually generates a torque in the wrong direction of rotation. When a simple wiper is used as a piston seal, the cylinder rotor would be a performance part. In special applications, it can be useful. The piston rods of a water hydraulic motor could have the properties of a rope. In reality, the piston rods could be made partly of properties like a rope when the piston rods are only pulling. A rope or a flexible piston rod moves automatically in the direction of the resulting force vector and simultaneously, it relieves each sealing element almost completely from lateral forces, presupposed the cylinder rotor is also arranged free floating. Therefore, the piston rods don't need a lateral stability within a certain range, and being free floating, they form self-aligning the optimal swept-back or inclination angle automatically for any working mode; pump, motor, opposite turning direction etc. This is another fact, which makes the pulling piston actuating mechanism superior over any pushing device. (A slanted cylinder in a cylinder rotor would have the same effect but also displays a negative side effect.)

A reduction of the inclination on the suction side causes a larger inclination on the pressure side, which makes it harder for the sealing elements, specifically a wiper, to provide a proper sealing quality, but there is no need for a pressure tightness or sealing properties, presupposed the housing is pressurized and there is a pulling piston actuating mechanism. This applies to simple wipers. In practice, spherical piston seals are used more often.

By using a spherical piston or piston seal, the sealing line shifts around the ball and is never inclined with respect to the cylinder. The surface-normal-vector of the sealing plane (all points of the sealing line lie in this plane) remains along the axis of symmetry of the cylinder, ergo, no lateral forces on the cylinder walls are generated by fluid pressure, ergo, the cylinder rotor is not a performance part.

If there is only one turning direction, spherical wipers and strait piston rods (actually screws) are attached via threads to the piston carrier, If they are swept-back with respect to the direction of movement, forces appear only on the piston carrier ergo the swept-back piston rods generate the useful torque directly on a piston carrier and a shaft. In the event that a sealing element is located on top of the cylinder and wipes along a piston plunger, there is a priori (naturally) no torque on the cylinder rotor, because the plane defined by the sealing line or by the corresponding surface-normal-vector is always straight to the cylinder, ergo, the cylinder rotor is here never a performance part. At least a specific number of the sealing elements can be flexible and slightly shiftable laterally.

For a simple pump, it can be enough, if at least the top of the cylinder rotor is made of a flexible material. The elastic circular edge of an enlarged cylindrical bore also provides a certain shift ability, and/or the piston plungers are laterally loose and/or flexible.

In the case of an axial machine, the later mentioned distance bolt or spacer pin between both rotors can be rotationally coupled at both ends and used as a torsion wire in order to transmit torque to the cylinder rotor to overcome the remaining friction. A spring can be used, which is rotationally coupled to both rotors and preloaded to transmit torque in the direction of rotation.

Looking at a radial piston machine, slanted piston rods, even ropes are not exactly radially directed but in a direction of the present force vector. The piston rods end on an inner circle where they generate torque directly on the piston rotor and shaft, respectively.

In accordance with these details for a balance in a transversal and, in particular, in a circumferential direction, it must not be forgotten that the greatest amount of reduction of all transversal forces or shifts is made by the reduction of the inclination angle and the respective eccentricity between both rotors; that is, the remarkably low changing characteristics of the cosine function around 0°. Small angles of about 5° are used. Machines with an inclination angle over 10° would demand much more effort to compensate or absorb these disparities.

Balancing the piston rods in a longitudinal direction: The achievement of more displacement volume will not be made by an unlimited increase in the inclination angle, but will result from an unlimited enlargement of the diameters of the pistons, simply by a photographic enlargement of the machine. An extremely high piston force may cause a so high tractive force on a relative slender piston rod that may cause even steel to pull off or breakup. However, this can be balanced too. Each piston rod must be sealingly surrounded or jacketed by a flexible pressure-tight material, like hard rubber, in the largest possible diameter. Because of the inclination, the diameter must be a little smaller than the diameter of the cylinders. This effect is similar to that of the piston plungers. This opens up the way to high performances and large machines, according to the present invention, while retaining the flexibility of a thin piston rod. This is right for pulling piston rods and a pressurized housing and shows another advantage of a pulling piston actuating mechanism over a pushing one.

All of this is possible but not necessary; a solid and stiff piston rod can always be used for any desired performance. Piston plungers will not pull off, because there is no tractive force on the plungers. If the plungers are sealingly attached to the piston carrier, the piston force pulls only on the piston carrier.

Balancing Procedure Without Pressure:

To balance this machine in the absence of pressure, for example, when initially starting the machine, a special fastening means is necessary to hold the cylinder rotor in a sliding fashion on the control surface, but only in the case of an axial piston machine. The cylinder rotor has the tendency to lift off from the lower part of the control plane and to straiten up, ergo reducing the inclination angle to zero. A spacer pin is positioned between both rotors in the center line of the piston rotor to hold the cylinder rotor against the control plane. The spacer pin (or pivot) bears swingable in a spherical hole in the cylinder rotor in a point of intersection between both rotor axes. A remaining axial clearance would cause a leakage gap between the control plane and the cylinder rotor, but this gap will be removed by using a compression spring around the spacer pin or by using other springy or resilient devices, which push the cylinder rotor against the control plane at a predetermined force. One end of the compression spring presses against the piston rotor or piston carrier or drive shaft and the opposite end of the spring presses against the cylinder rotor or a step of the spacer pin and the spacer pin presses against the cylinder rotor.

The strength of the spring must substantially overcome the frictional forces of the pistons in the cylinders in the absence of any system pressure. The weight of the cylinder rotor may help to generate this force. The friction of the sealing elements is made as low as possible. This ensures that a machine, such as a pump, can run dry without noticeably heating up while maintaining a good suction capability.

Balancing of the Shaft Seal:

It is well known that a mechanic shaft seal needs a larger shaft diameter on the rotating part of a seal for a balance at high pressure. A necessary wider shaft may provide a husk or sleeve on the backside of the piston rotor. The rotating part of the shaft seal can be mounted directly on an end of the piston rotor with a diameter suitable to achieve a proper balance between two adjacent sealing rings and can be driven by drive dogs on the end of the husk.

The diameter of the husk and the diameter of the shaft seal can be made in any size, which may balance the cylinder rotor in an axial direction.

Balancing Procedure in the Presence of Foreign Particles:

A special device is necessary to prevent damage to a machine due to incoming foreign particles that may cause a devastating high point contact pressure. This may result in the destruction of the machine. A theoretical solution is to remove the possibility of too high amounts of a contact pressure. A practicable solution is an application of such sliding parts which are only held in place by a spring, or by fluid-pressure.

In case of an axial machine, this concept is easy to use for a sliding area between a cylinder rotor and a control plate. A cylinder rotor is held on the control plate only by fluid pressure and a compression spring. In this case, the spacer pin is removed or replaced by a suitable device. (for instance by a pin with features like a telescopic pin). When a foreign particle comes into this area, the cylinder rotor will lift-off and come back down when the particle is through the machine.

Another matter of concern is with respect to the frictional relationship between the piston and the cylinder. A soft sealing element has to remain on the cylinder wall and would scratch the cylinder wall if a sharp and hard foreign particle sticks on it. But this can be prevented for pulling piston rods, by using a retaining-spring around the piston rod as a holding device in a longitudinal direction for a sealing element on the piston head. The spring is strong enough to overcome a normal friction between the sealing-element and the cylinder wall. If a particle blocks the axial movement of the sealing element relative to the cylinder wall, the spring will be compressed periodically and the sealing element will not execute the full stroke motion or any stroke motion relative to the cylinder until the foreign particle is gone.

Both applications of this concept together make the machine robust and durable against the impact of foreign particles. Now, in view of the foregoing discussion, this rotary piston machine, especially the axial version with a pulling piston actuating mechanism has a unique quality in that every movable part is balanced or counterbalanced, including the drive shaft. A burdensome contact pressure exists nowhere in this machine in spite of high pressure within the machine. The friction is minimized, even at a high pressure, at high speed, and for large volumes.

Many versions and combinations of these machines are possible. This principle is characterized by the largest range of variable parameters, such as pressure, displacement volume, speed, performance and others. Without any fluid, the friction can be minimized so significantly that machines, such as pumps, can permanently run dry without noticable warming and retaining a good suction capability. Conventional axial piston pumps already have the best efficiency, but this invention will improve the efficiency even without using oil. There exists not only high pressure water pumps in a range of several kilowatts, but also a very small three-cylinder pump with an electric capacity of less than 10 watts and a delivery of less than 1 liter per minute; and after all, this pump has, dry running, a suction capability of several meters.

The above described concepts are applicable not only to axial or radial rotary piston machines, or between them, but also for all desired variable parameters, such as displacement volume, pressure, or performance, and fluid parameters. This machine has been invented and developed, in particular, for media without a lubricating ability, like oil-free air and clean water. Examples are: permanently dry running pumps without valves, but with a unique suction ability, even by the smallest possible displacement volumes; high pressure water pumps for every volume; water hydraulic motors for every performance; vacuum pumps; oil-free compressors for high pressure; air motors; engines; metering pumps; special pumps for a gas-fluid mixture; and others. There is also a whole scale of combinations of the versions. For instance, a water hydraulic motor, driven by any fluid under pressure, for energy recovery systems, in particular, for the reverse osmosis. A high percentage of sea water at a pressure of about 70 bar (1000 PSI) comes out the drain of the reverse osmosis system and this energy is wasted in today's systems. A water hydraulic motor according to this invention can be connected to the drain and drive a pump to feed the same or another system with fresh sea water without additional energy costs. The same procedure can be repeated. The electrical equivalent of such a machine would be a transformer or motor generator unit. An axial piston pump and a motor can be attached to the same shaft. The same formations of the same pistons are directed oppositely to each other.

The inclination angle (and so the delivery) is a little smaller for the pump, compared with the motor, with it the pump is able to generate a higher pressure than the motor is running with to feed the same system with fresh sea water. Sizes for millions of Liters per day are possible. Another example is an air compressor, driven by a water hydraulic motor, wherein the water can be replaced by any other non-abrasive fluid. This system works for submersible applications too. For instance, it can bring compressed-air into water, such as in oxygen lost lakes. The air is mixed with water under high pressure, raising the efficiency of today's methods significantly. It shows that this pump is a compressor, which is able to generate an extremely high air pressure in one stage, if water is applied as system fluid for a better sealing function etc.

Usually, the required delivery pressure by compressors is not that high as for the water-hydraulic and pressure compensation for the sliding parts is not so decisive. Therefore, the cylinder rotor can be guided by its own shaft or stub shaft without special bearings and the cylinders can almost be closed on the bottoms. In the case of axial machines this allows a significant reduction of the control device to a small interior area having the lowest sliding speed. This is an advantage when using large cylinders.

In the case of an axial compressor or engine, there is a special way to reduce or eliminate the disparities between the pistons and cylinders due to the inclination between both rotors. The cylinder axes are bent around a hypothetical globe or ball with the center of the globe in a point of intersection of both axes and a diameter with the distance between the two diametrical cylinders. The bent axes or better middle-lines of the now non-strait-sided cylinders are lying now in a great-circle of said globe. This eliminates said already discussed radial deflections between the pistons and cylinders. The deflections of a two cylinder machine with two oppositely arranged and arched cylinders and spherical pistons are exactly zero, ergo no shifts are necessary. This is a priori true for one cylinder machines. Each of the rotors can be made totally rigid. Therefore, such a machine is suitable for a very high speed, large displacement volumes, and also for a greater angle between the rotors. The sliding speed is relatively low and no mass power exists. The channel control divice can be very close to the axis of the cylinder rotor or valves can be used instead.

The applications of this invention for gas as a media include a compressor, an engine or an air motor with or without water as an operating or system fluid for sealing and cooling in the housing. In case of an engine, one unit works as a compressor to feed a combustion chamber and after it, the second modified machine works like an air motor for hot gas. Both units can be mounted on the same shaft or can be rotationally coupled by gear wheels or the like. All parts can be cooled by the operating fluid. In this case, oil can be used for cooling and lubricating. In this case, the pistons need oil rings. Said version with a spherical piston, surrounded by a cylindrical sealing element, is suitable. With this engine, it is possible to combine the relative low speed of a classical piston engine with a continuous combustion of a turbine. It can be called a "Displacement Turbine".

BRIEF DESCRIPTION OF THE DRAWINGS

FIG. 32*a* shows a partially sectional view A-13 A according to FIG. 32*b* of a radial one-cylinder machine and FIG. 32*b* shows a partially sectional view perpendicular to the first one;

FIG. 33 shows a partially sectional view of another radial one-cylinder machine;

Similar reference characters denote corresponding features consistently throughout the attached drawings. These drawings are made for clarification, not for any restrictions.

DETAILED DESCRIPTION OF THE PREFERRED EMBODIMENTS

Figure 1:
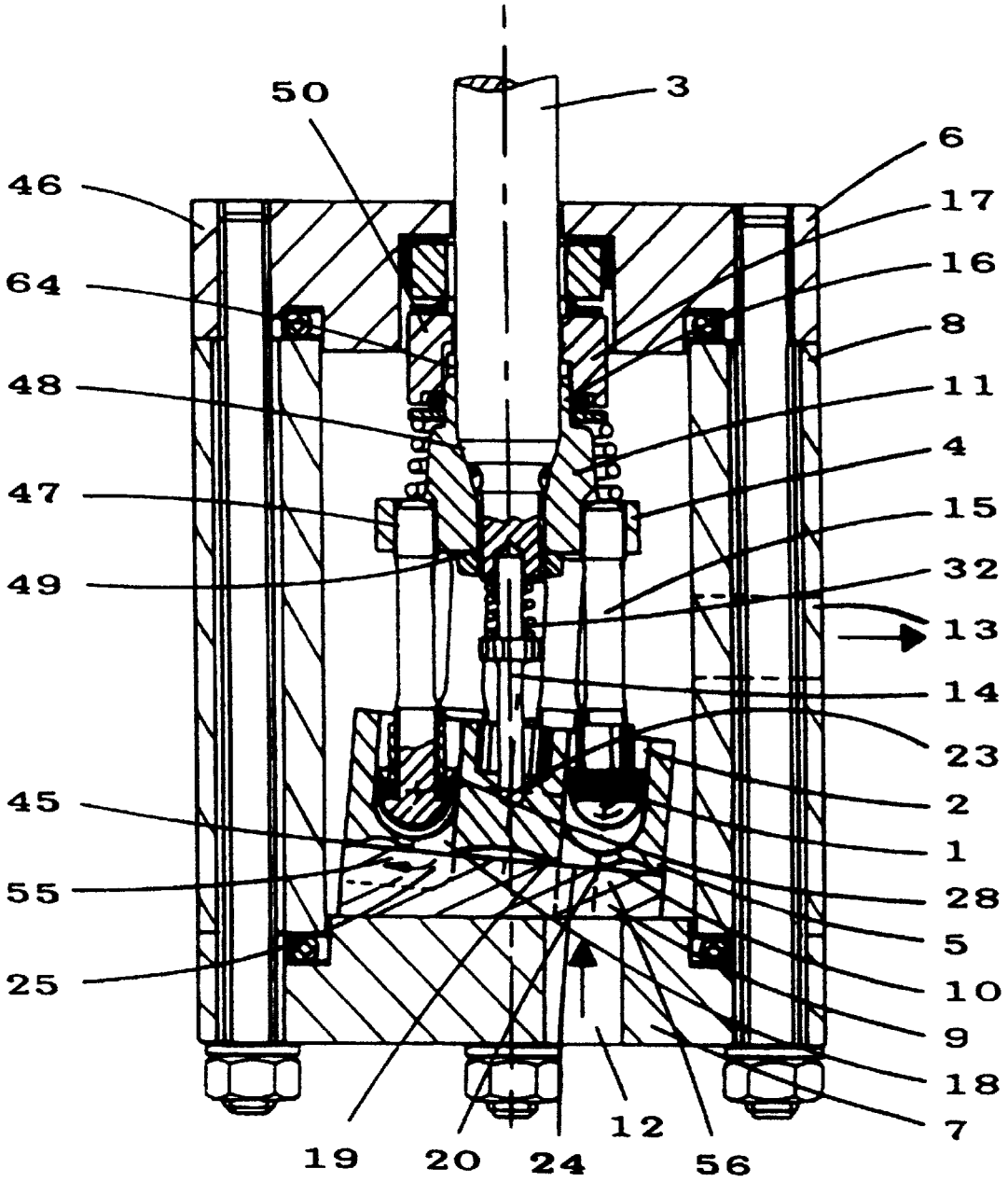
FIG. 1 shows a partially sectional, elevational view of an axial-piston-machine in accordance with the present invention.

FIG. 1 shows a sectional view of an oil-free axial-piston-machine as a high pressure pump, in particular, for non-lubricating fluids like water. Six cylinders 2 are disposed in a rigid single-piece cylinder rotor 5 which slide upon a slanted control plane 10, being the front side of the stationary control plate 9. Said control plate 9 is obliquely mounted on the endplate 7 at an inclination angle of about 5°. The pressurized housing 46 consists of a flange 6 and an endplate 7, which are connected via a pipe 8. The piston rotor 4 consists of pistons 1, piston rods 15 and a piston carrier 11, which is rigidly connected to a drive shaft 3 via a taper 48 and a thread 49. The piston rods, actually screws are attached to the piston carrier 11 via a thread 47 with a certain clearance, which allows a certain lateral movement of the pistons 1 depending on the length of the piston rods 15. The fluid enters the pump through the low pressure port 12 and goes through the kidney-shaped canal 24 in the cylinders 2. After a half revolution the cylinders are being disconnected with this canal and they are being connected with the high pressure control canal 25 on the high pressure side 55. This control canal 25 is actually a groove in the stationary control plate 9 (see FIG. 1*a*) connecting the cylinders with the housing 46 for a moment. After this, the fluid is pushed out the cylinders without pressure difference and goes in the housing 46 and leaves it through the high pressure port 13. Over one half of the control plate 9 is low pressure which is the location of the low pressure channel 24 and the low pressure port 12. The control plate is divided into a stationary high pressure side 55 on the left and a stationary low pressure half 56 on the right (FIG. 1;1*a*). The cylinder 2 being circularly moved, with its control openings 18 sealingly sliding upon the stationary control plate 9, and experiencing said two pressure levels within one revolution.

Thereby, the pistons 1, actually the piston rods 15, pull over the low pressure half 56 against the high pressure in the housing 46. This creates a pulling piston actuating mechanism. Consequently, the piston seal 28 must be pressure-tight in only one direction and only in time over the low pressure side 56. (The piston seals 28 experience only one high pressure level, the delivery pressure in the housing 46.) The piston sealing element 28 shown here is a cone shaped special plastic wiper with a relatively stable or firm body diameter, but with a flexible sealing lip, because said wiper is the only contact between cylinder and piston and must drive the cylinder rotor. It has both sealing and guiding features. The body diameter of the sealing elements are smaller than the diameter of the cylinders to provide shifting space to absorb the disparities perpendicular to the short stroke motion.

These lateral disparities can be also absorbed by the angular clearance in the thread 47 combined with a specific length of the piston rod 15. (A longer piston rod 15 generates a greater swing amplitude on its end where the piston seal is located). The piston rods, which are actually screws, can be made in stainless steel or in a plastic compound reinforced with carbon fiber or other fibers.

The cylindrical housing 46 consists of the endplate 7, and a flange 6, both being connected by a pipe 8. The low pressure or inlet port 12 is located in the endplate 7, near the control mechanism, and the high pressure or outlet port 13 is located in the pipe 8, preferably on the top, to exhaust air from the pump. The cylinder rotor 5 is interengaged and guided by the pistons 1 from a piston rotor 4 rotating with the same average speed as the piston rotor 4. The cylinder rotor 5 has no self guiding parts, such as a shaft.

Each piston 1 operates in one respective cylinder 2. The pistons 1 are securely attached to the piston carrier 11 via strong piston rods 15, with threads 47 on the end. The piston carrier 11 is securely mounted on the shaft 3 via a tapered portion 48 and a thread 49. The piston rotor 4 consists of the piston carrier 11, the piston rods 15, and the pistons 1, which are fluidly connected, that is, without bearings or bearing-free, or integrated to form one piece, including the shaft 3. The piston carrier 11 has on its backside a husk or sleeve 16 with drive dogs 64 on end thereof to drive a rotating sealing part 17 of the mechanical shaft seal 50.

The piston rods 15 are attached to the piston carrier 11 slightly tilted in a circumference direction in order to bring the tractive or pulling force vector closer along a longitudinal axis of the piston rods 15. (Balance in circumferential direction). This small angle is seen in FIG. 1 on two of four shown piston rods 15 in the background. Said angle is smaller than the inclination angle between both rotors. All six piston rods lie still in a fictive cylinder defined by the former or original exact axial directed piston rods.

The axial balance of the entire machine can be described briefly as follows. In the middle within the machine three pistons 1 separate the high pressure within the machine from the low pressure on the outside, ergo they unbalance both rotors. The piston rotor 4 is counterbalanced by the shaft seal 50, which separates the high pressure in said housing from the outside on the opposite axial end of the machine, with the same sealed area content of three cylinders 2 together. The cylinder rotor 5 is counterbalanced by a low pressure field around a low pressure channel 24 with the same size. To get the right size of said low pressure field, the control openings 18 in the control surface 45 of the cylinder rotor 5 must be reduced to about half of the cylinder cross sections.

Here is the same situation detailed: The sum of all axial forces on the piston rotor 4 is zero. At any one time, there are three of six pistons 1 just over the low pressure half 56 of the control plate 9. These three working pistons 1 generate a pulling force on the piston actuating mechanism and finally on the shaft 3 due to the pressure difference between the high pressure in a housing 46 or pipe 8 and the low pressure in the three cylinders 2 which are just being over the low pressure half 56, and being connected to the kidney-shaped low pressure channel 24, and the low pressure duct 12. These three working pistons out of six pistons 1 have together the same area content as the cross section of the sealed diameter of the drive shaft, which is actually the cross section of the husk 16. In respect to the hydrostatic pressure balance of the piston rotor 4, the outgoing shaft 3 pulls like an additional seventh larger piston (husk 16) but in an opposite direction. Now, if the pressurized areas with an opposite force vector, that is, three pistons 1 and the cross section of the husk 16 for the shaft seal 17, have the same area content, then, the entire rotating power part is axially in balance; this includes the piston rotor 4 with the pistons 1 and the drive shaft 3. (Radial remains a force which bent the shaft laterally). What remains are usefully torque-generating tangential forces on the piston carrier 11, generated by the piston rods 15. Consequently, the fluid power is directly converted into a useful torque, and vise versa. The piston force is not transmitted through bearings. In other words, even when the pistons 1 have to work against high pressure, they do not generate a burdensome bearing or contact pressure.

Practical experience has shown that a pump at 100 bar or more can be directly attached to a standard electrical motor having standard ball bearings. The axial force balance is in reality not exactly zero. A specific axial preload is advantageously applied in order to get the axial-clearance out of the ball bearings and to suppress any axial vibrations.

This rotary piston machine can operate as a high pressure water pump and vise versa as a water hydraulic motor. The only difference is a reverse flow and a reverse turning direction. The port 12 is still the low pressure port in both applications, for a pump and for a motor as well. This unique concept is simple, powerful, and highly efficient. This mechanism does not depend on the inclination angle between both rotors, like conventional axial piston machines.

The said balance of the cylinder rotor with other words: At a high pressure in the housing 46, it is advantageous to apply an axial pressure balance for the cylinder rotor 5 also to release it from any burdensome contact pressure against the stationary control plate 9.

The cylinder rotor 5 can be considered first of all as a full disk having two oppositely circular end faces with effective pressure fields, generated by two pressure levels, a high pressure in the housing 46 and a low pressure in the low pressure channel 24.

The circular face of the cylinder rotor adjacent to the control plate is its control surface 45, which is profiled. A ring-shaped area between the circular border lines 19 and 20 is lapped and is the only sealingly sliding area for the channel control mechanism. All other areas of the control surface 45 are hollow and they don't touch the control plane 10, except a ring on the outer skirt of the control face 45 which operates as a wear ring. One half of the cylinder rotor, the half, momentarily being over the stationary high pressure side 55 of the control plate 9, is a priori in balance, because there is everywhere in this region the same pressure, the high pressure of the housing 46. But in three cylinders, just being over the low pressure side 56, is low pressure. This fact defines a low pressure area for the cylinder rotor, because this portion of the pressure field hangs on three pistons 1, ergo on three piston rods 15 and finally on the piston carrier 11. On the other hand, there is a counterpart, that is a low pressure field around the control channel 24. The size of this low pressure field can be adjusted and equalized to its counterpart (three cylinders) to achieve a proper pressure balance of the cylinder rotor.

Remember, the cylinder rotor 5 is axial in balance if the overall size of the pressure areas on both circular faces are equal. Therefore, the low pressure area between the cylinder rotor 5 and the control plate 9, is an area around the kidney or banana shaped control channel 24, which is a larger kidney shaped area. It must be adjusted to the same size as three cylinders 2. If this area would be less than three cross sections of the cylinders 2, the rotor would lift-off. If this area would be larger than three cylinders, the cylinder rotor would be pressed against the control plate.

Figure 1A:
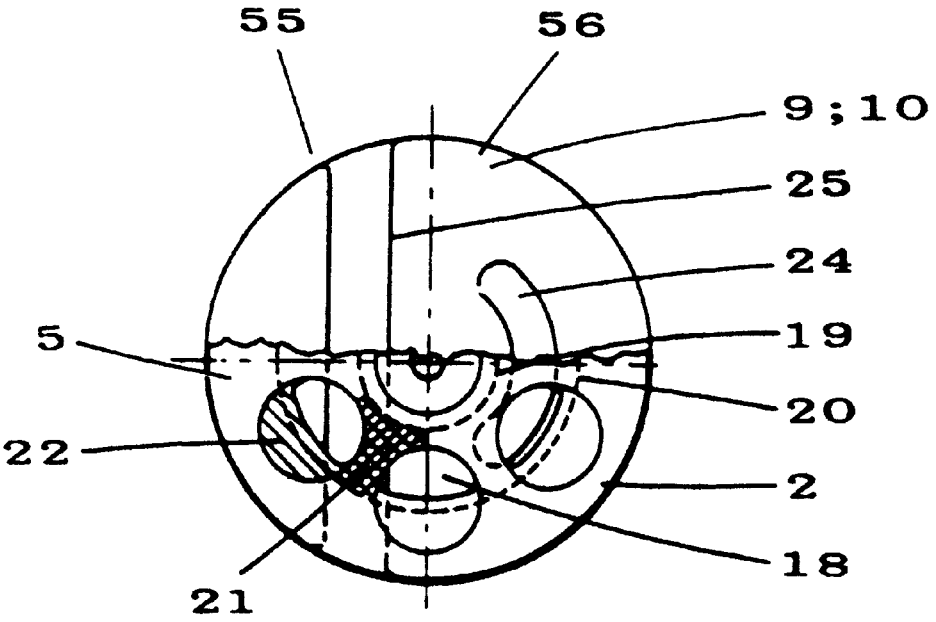
FIG. 1*a* shows a partially broken plan view of a control plate with a cylinder rotor shown partially in full.

For an equal area content, the radial extension of the area or the radial distance between the circular border lines 19 and 20 must be less than the diameter of the cylinders. Therefore, the cylinders must be partly closed (otherwise they would not be sealed up). (In practice, this sealed-up low pressure area around the channel 24 is just a little larger than the sum of three cylinder cross sections to gain a necessary sealing pressure.) If the whole cylinder cross section would be open and the border lines 19 and 20 would have to go around them, the low pressure area would be larger than three cylinder cross sections, because there is, besides the cross sections of the cylinders, an unwanted (and unbalanced) area or section of the cylinder rotor 21 between two neighboring cylinders and between the border lines 19 and 20 in the contact plain between both control plains as shown in FIG. 1*a*. All areas 21 lie in the path of the control openings 18 always experiencing the same pressure as the neighboring cylinders and are the reason for a necessary balancing procedure. The area 21 must be sealingly sliding for a proper control mechanism. Both areas, the area 21 and the newly created area 22, lie in the contact plain of both control plains 10 and 45. The axial projections of both areas define the sections 21*s* and 22*s* of the cylinder rotor, which are both unbalanced. That is precisely, the section 21*s* is counterbalanced by the newly created pressurized area 22 located in the section 22*s* of the piston rotor. Looking first at the section 21*s* in the low pressure half 56 for both faces of the cylinder rotor 5, there is low pressure underneath the cylinder rotor in the contact plane between both control planes, but high pressure on top of the cylinder rotor on the opposite face, ergo this section 21*s* is unbalanced. This section must be counterbalanced by another unbalanced section with an oppositely directed force vector. This is the reason for a partial closing of the cylinders.

Achieved is a counterbalance of the unwanted, but necessary area 21 with the newly gained area 22 under the cylinders, both having about the same area content.

Looking now at the section 22*s* in the same situation, there is now high pressure in the contact plain of both control surfaces 10 and 45, but no pressure on top of the cylinder rotor 5 for this section, because the piston has taken over this pressure field within the cross section of each cylinder. This section 22*s* is also unbalanced, but both sections 21*s* and 22*s* generate an oppositely directed force. Equalizing both area contents of the areas 21 and 22 completes the desired hydrostatic pressure balance on a low pressure side 56. Now exists an enlarged high pressure cushion in the so called low pressure side 56. The resulting force in section 22*s* is directed away from the control plate 9 and the force in the section 21*s* points at the control plate 9. The desired balance is achieved.

All other hydraulic forces effecting the cylinder rotor 5 are a priori substantially balanced because everywhere else is high pressure due to high pressure in the housing 46.

In respect to an axial balance, the cylinder rotor 5 can be treated like an outgoing shaft wherein a "shaft seal" has a cross section of three cylinders 2. Actually, the cylinder rotor 5 works here as a sealing element for three pistons 1 which separates the high pressure from the low pressure channel 24.

These are different ways to describe the same situation, the pressure balance of the cylinder rotor 5. FIG. 1*a* illustrates this situation. It shows area 21 and the respective section 21*s* in a view of the halves cylinder rotor 5 lying on the control plane 10. The area 21 is defined by the circumference of two neighboring cylinders 2 and by both of the circular border lines 19 and 20, the interior line 19 and the exterior line 20. The circular lines 19 and 20 border the entire ring shaped lapped sealing area and can actually be radial steps on the control face 45 of the cylinder rotor 2. The size of area 21 is almost equal or a little larger than the size of the new area 22, that is, the covered part of the bottom of the cylinder 2.

Further, FIG. 1*a* shows the contour of the control plate 9 or control plane 10 with a reniform or kidney-shaped control channel 24 on the low pressure or working side 56 on the right and the control groove 25 on the high pressure side 55 on the left. In practice, line 20 will be shifted just so far to the inside that the cylinder does not lift-off from control plate 9.

The balance of the cylinder rotor 5 is optimal if the "disc loading of the system" will be just equal to the necessary contact-pressure to achieve a proper pressure tightness.

An optimal pressure balance is important, especially for the start of a small water hydraulic motor, because the static or stationary friction is greater than the dynamic friction. In absence of any fluid pressure, the sealing pressure for the cylinder rotor 5 is provided by a compression spring 32. It is located in the center-line of the piston rotor 4 and is pressed between the end of the shaft 3 and a step on the spacer pin 14, in order to push the pin in the cylinder rotor 5 and the rotor against the control plate 9. The spacer pin 14 is gimballed in a spherical hole 23, which defines the pivot point of the cylinder rotor 5 in a co-rotating system. This point lies in the intersection of both axes and axially in the middle of the stroke motion. The spacer pin 14 has a certain length to prevent a lift-off of the cylinder rotor 5 from the control plane 10. If the machine works under pressure, this device is not necessary.

The foregoing description of a hydrostatic pressure balance was made for the simplest case, a pulling piston actuating mechanism and with only two different pressure levels within the machine. The same balancing procedure can be made for any other variety of this machine as well, for instance for a pulling/pushing piston actuating mechanism and with 3 different pressure levels within the machine.

Figure 2:
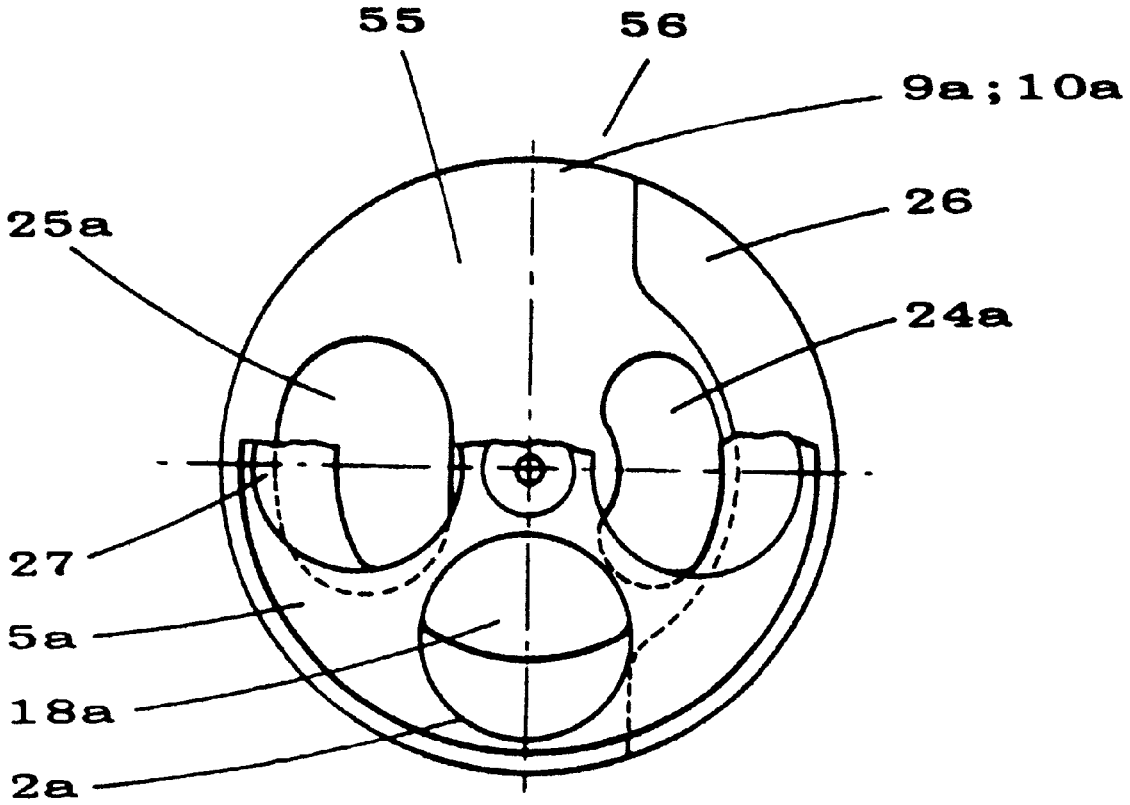
FIG. 2 shows a partially broken plan view of a cylinder rotor with a control plate shown in full.

FIG. 2 illustrates a hydrostatic pressure balance of the cylinder rotor on both halves, the low and the high pressure half, separately. This figure is the equivalent to FIG. 1*a*. FIG. 2 shows the control plate 9*a* with the control plane 10*a* and a half cylinder rotor 5*a* having four large cylinders 2*a* with the control openings 18*a*. The piston rods pull over the low pressure side 56 and push over the high pressure side 55 throughout one revolution, while about half of the delivery pressure is in the housing. Here, the sealingly sliding control surface of the cylinder rotor 2*a*, that is its control face, is totally plain or non-profiled and the control plate 9*a* is profiled by a lower level on the low pressure side 56, the area 26. Practice has shown that it is wise to profile only the control plate 9*a* in carbon, instead of the cylinder rotor. The stationary control channel 24*a* on the low pressure side 56 is smaller than the control channel 25*a* on the high pressure side 55 in order to balance both sides separately. On the low pressure side 56, as shown on the right, is applied the same aforementioned balancing procedure.

On the high pressure half 55, the covered area 27 is much smaller than the equivalent area 22 from FIG. 1*a*, because this time, the delivery pressure is in the cylinder 2*a* and the pistons are pushing in the old fashion way. Only a small sealing area 27 is effected from the pressure in the cylinder to generate a low contact pressure for a proper sealing on the high pressure side 55. If the leakage on both sides 55 and 56 is about equal, than in the housing 46 is only about half of the delivery pressure. A balance can be achieved on both sides 55 and 56, in any case, (for a pulling, pushing or pulling/pushing piston actuating mechanism and any pressure) by partially closing the cylinders and by varying the different pressurized areas, that is by profiling the control plate 9*a* in a proper manner.

Figure 3:
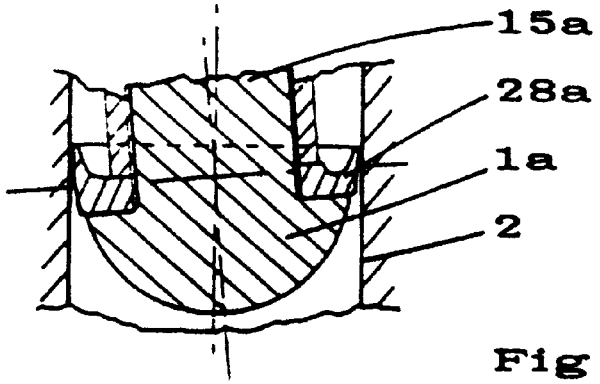
FIG. 3 shows a partially sectional, partial elevational view of a piston in a cylinder and a slanted sealing element or wiper.

FIG. 3 shows a "puller piston" 1*a* in the cylinder 2 on a pulling piston rod 15*a* and a sealing element or wiper 28*a*. This seal is pressure tight in one direction only.

Figure 4:
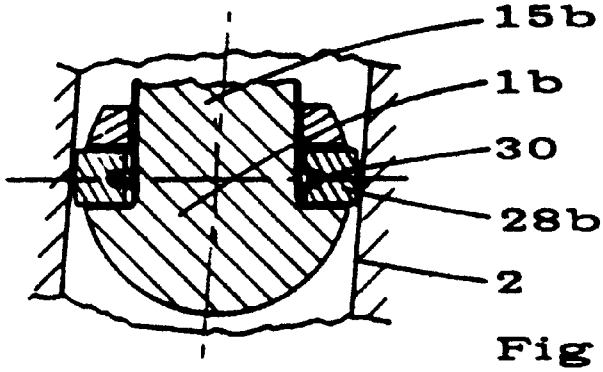
FIG. 4 shows a partially sectional, partial elevational view of a piston with a spherical piston ring.

FIG. 4 shows the piston 1*a* with a piston ring 28*b*, which is exteriorly spherical forming an exact circularly sealing line, which is variously slanted on the piston ring 28*b*. Consequently, the surface-normal-vector 58 of the sealing plan 57 is never slanted in the cylinder 2 (shown in FIG. 10), and furthermore, the fluid pressure does not generate lateral forces on the cylinder walls and no torque on the cylinder rotor 5 as well. Like a classical piston ring, this piston ring 28*b* is fixed along the stroke or longitudinal direction, is rotationally free and is self-aligning to the cylinder wall. Between piston ring 28*b* and the piston 1*b* or better to say piston rod 15*b* is a suitable radial or lateral clearance, allowing the piston rod to shift laterally in any direction for a predetermined amount, whilst the spherical outside of the sealing element remains permanently on the cylinder wall 58. The piston sealing element 28*b* is self-aligning to the cylinder wall and floating to the piston rod. The center of the piston 1*b* and the piston rod 15*b*, that is actually a screw with a head, being allowed to leave the center of the cylinder and the center of the piston sealing element for a certain predetermined amount. Said lateral clearance is an important parameter of such a machine. This certain movability, possibly together with other shiftable parts, enables said lateral shifts to absorb (not eliminate) said lateral disparities between piston 1*b* and cylinder 2 caused by the inclination between both rotors enabling this invention to work.

When the piston ring 28*b* is of synthetic material, like plastic, the sealing pressure and memory of elasticity can be supported by a steel ring spring 30. This sealing element 28*b* is pressure tight in both directions and suitable for the majority of all applications. Actually it is a combination between a seal and a wear ring, because the piston itself never touches the cylinder wall.

Figure 5:
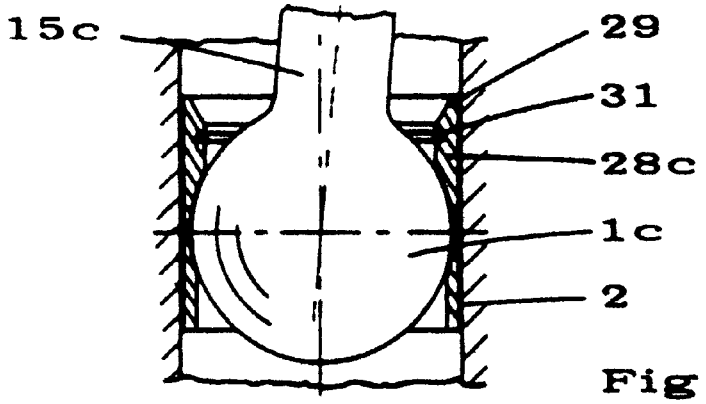
FIG. 5 is a partial elevational view of a piston shaped like a spherical bearing and a partial sectional, elevational view of a cylinder.

Now referring to FIG. 5, which is another version of a piston 1*c*, where no torque is generated on the cylinder rotor 5 by fluid pressure. There clearly is a local separation between the guiding function and the sealing function on an extended piston sealing element 28*c*.

A spherical piston 1*c* is swingable or gimballed born in a guiding and sealing element 28*c*, which is spherical on the inside and cylindrical on the outside. It works, if it is in thin plastic material, in the zone around the equator of the spherical piston 1*c*, like a wear ring, and on its ends like a wiper with a sealing lip 29. The preload provided a circular spring 31 again. When using large pistons, such as for engines, piston rings and oil piston rings are placed in the cylindrical part 28*c*.

Figure 6:
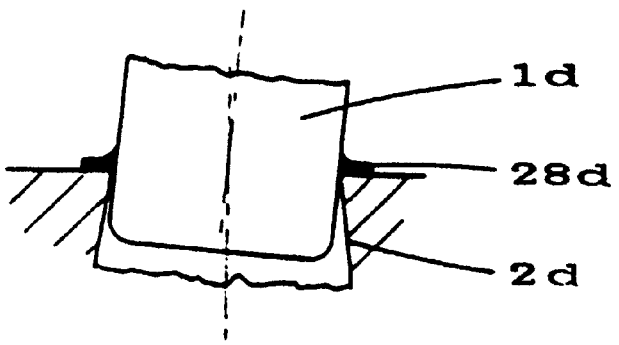
FIG. 6 shows a partial elevational view of a piston plunger with a wiper and cylinder.

Now referring to FIG. 6 a sealing element 28*d* is located on top of a conical or tapered cylinder 2*a*, where the cylinder 2*a* has its smallest diameter, and the piston is a smooth plunger piston 1*d*, with an exterior cylinder wall as the sealing surface. This sealing element works like a wiper on the plunger. The high pressure is in the housing. It is fixed in a longitudinal direction on top of the cylinder 2*d*, but it is shiftable laterally and flexible. The wall of the cylinder 2*d* is conical and wear free. But in this case a dead volume always remains in the cylinder 2*d*. When the entire cylinder rotor (not shown) is made from elastic material, the upper narrowest end of the cylinder 2*d* can take over the function of a sealing part 28*d* suitable for a very simple pump version.

Figure 7:
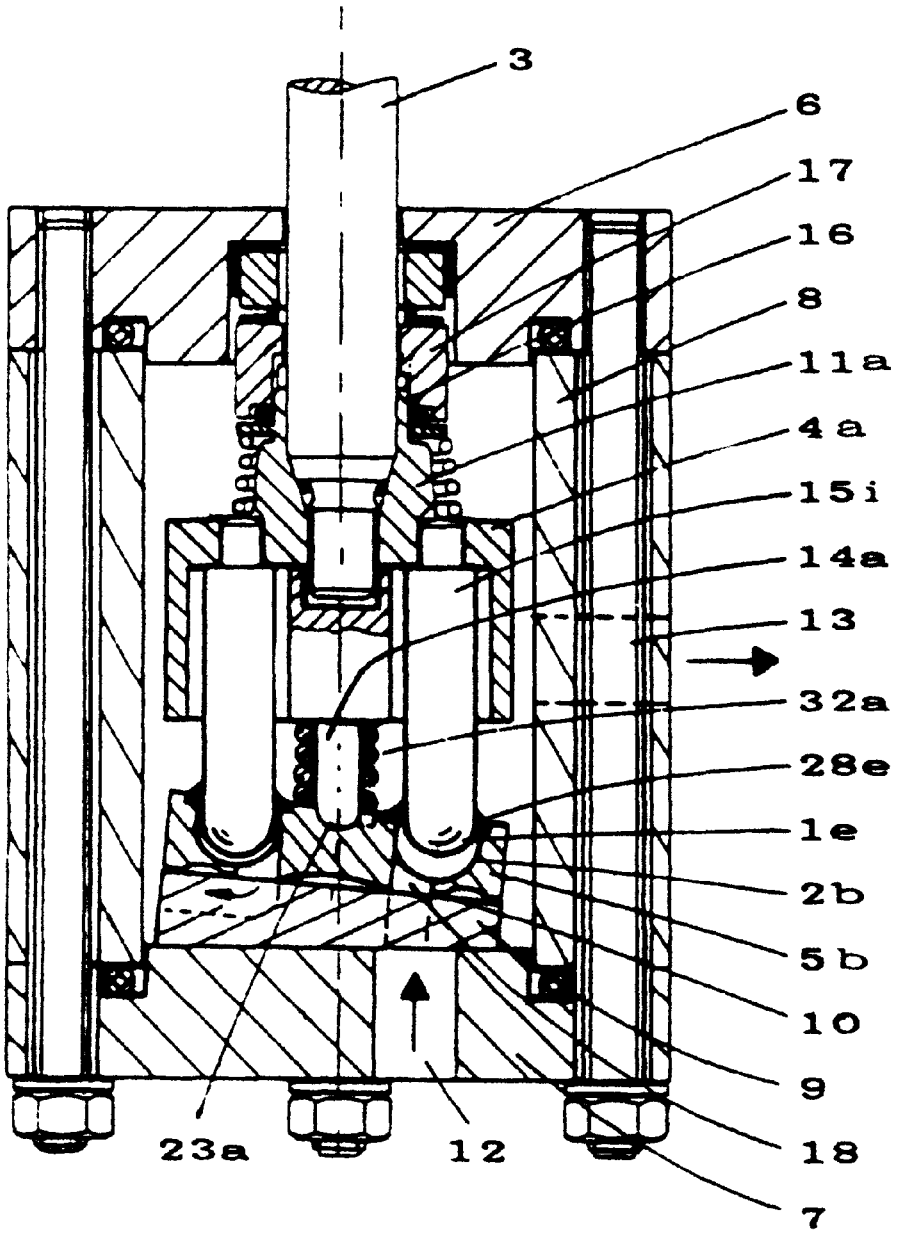
FIG. 7 is a partially sectional, elevational view of an axial-pi-ston-machine with piston plungers.

FIG. 7 shows, on the one hand, the machine with the plunger pistons 1*e* and the sealing elements 28*e*, according to the example from FIG. 6. On the other hand, it is similar to the structure shown in FIG. 1, with basically the same working mechanism. This is an example to show that combinations between variations are possible too. The main difference here is that a sealing element or wiper 28*e* sweeps on the plunger piston 1e or respective piston rod 15*i*, instead of sweeping on the wall of the cylinder 2*b*. A flexible sealing element 28*e* is placed on top of the cylinder 2*b* in the cylinder rotor 5*a*, and it is slightly sideways or laterally shiftable. Further, the spring 32*a* is stronger and is rotationally coupled on both ends, and is preloaded in a rotating direction in order to remove lateral forces from the sealing elements 28*a*. A more stable spacer pin or distance bolt 14*a*, born in a spherical hole 23*a*, centers the cylinder rotor 5*b*.

Figure 8:
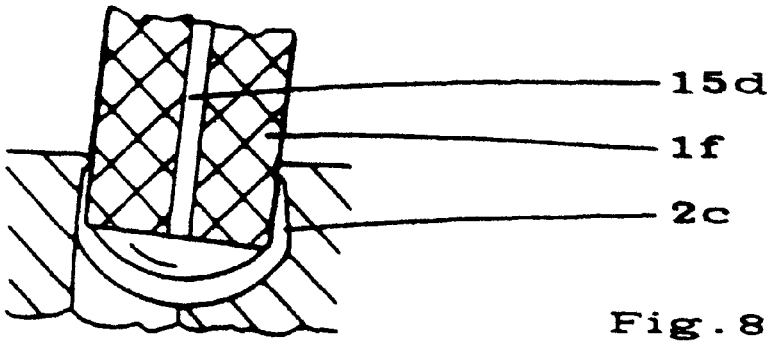
FIG. 8 is a partial sectional, elevational view of a soft piston plunger, and a hard cylinder.

FIG. 8 is another version of plunger piston 1*f*, but the piston plunger is in soft material and the cylinder 2*c* is in rigid material. The upper narrowest annular sealing edge of the cylinder 2*c* is rounded and presses a little against the soft plunger 1*f* to gain a proper pressure tightness. This version is suitable for a simple pump. A piston rod 15*d* is thin and flexible. There is practically no tractive or pulling force caused by fluid pressure on the piston rod 15*d*, if it is sealingly attached on the piston carrier 11.

Figure 9:
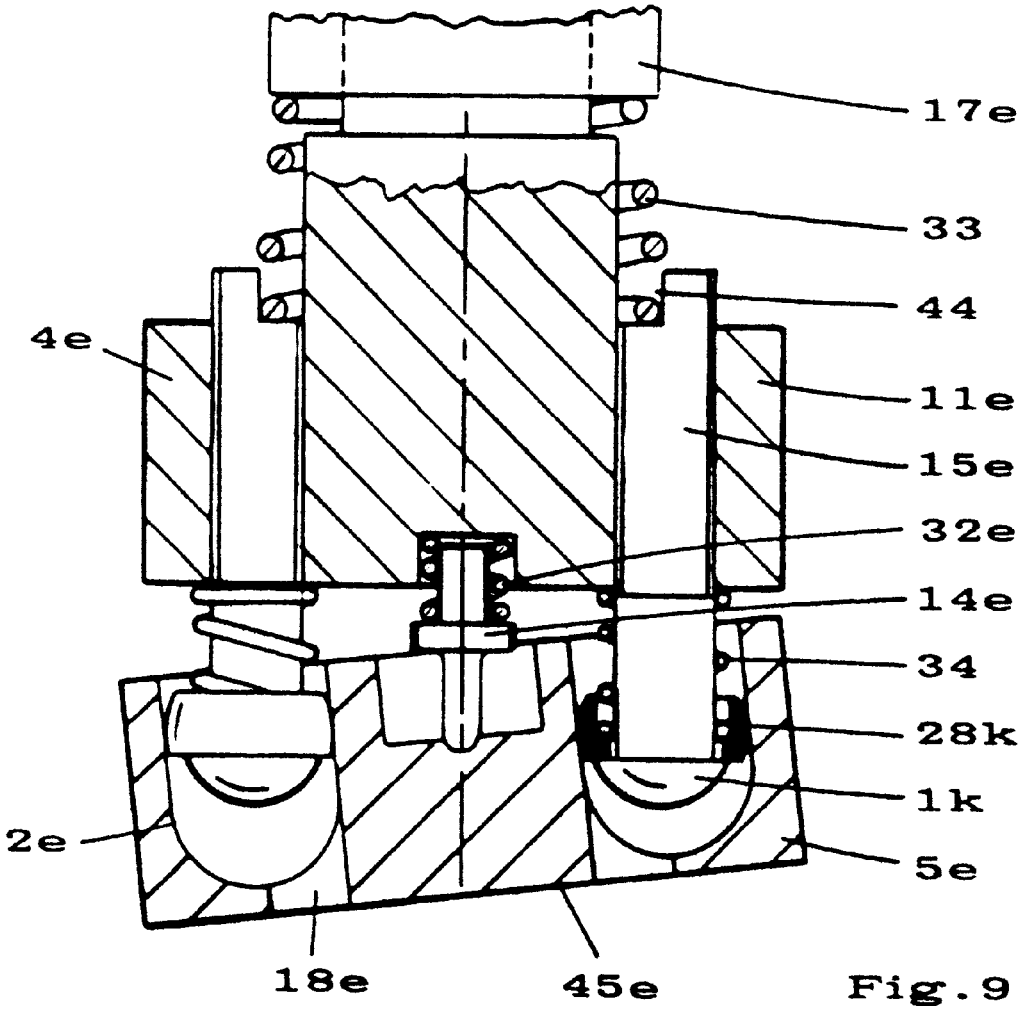
FIG. 9 shows a partially sectional, elevational view another version of rotors for an axial-piston-machine.
Figure 9A:
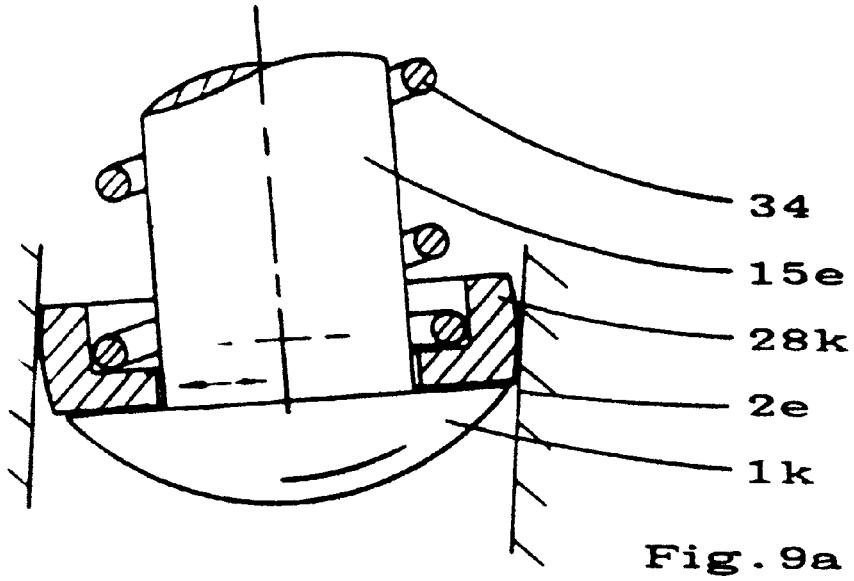

FIG. 9 shows a very powerful and wear resistant pulling piston actuating mechanism or power train for use in all axial piston machines, as is shown in FIG. 1 at high performance and without lubrication. The strong piston rods 15*e* are attached to a piston carrier 11*e* and rotor 4*a* respectively via a long thread 47*a* that is not tightened by a nut or the like. The piston rods 15*e* with the pistons 1*k*, which are actually screws, are secured against coming loose by a ring compression spring 33, which lies on the backside in a fitting cut-out of the six screws. This can also be done by a ring (not shown) fitting in a cut-out or bore 44 of the six screws (only two are showing) defining respective piston rods 15*e*, or it can be accomplished by using other locking devices. Practice has shown, that a normal clearance in a thread alone allows such lateral shifts, which are already enough to absorb the said deflections for small inclination angles between both rotors. A greater lateral mobility or amplitude for the pistons 1*k* can be achieved very easily, that is, by simply lengthening the crews or piston rods with the same angular clearance in the thread.

The main parts of the machine are shown here, which are the piston rotor 4*e* and the cylinder rotor 5*e*.

The spacer pin 14*e* with the spring 32*e* performs the same task as in FIG. 1.

The sealing element 28*k* is partly (equator slice) spherical and also slightly shiftable laterally (both lateral mobilities can work together or alone) with respect to the piston rod 15*e* or piston 1*k*, and is self-aligned with respect to the cylinder 2*e* like a floating arrangement. The piston seal element 28*k* is longitudinally secured via a compression spring 34 and the pistons work only over said low pressure half or side. The piston rods pull against a delivery pressure in the housing 46, not shown. Unlike the pushing piston rods, the pulling piston rods are self-aligning to the longitudinal force vector like a rope, which is a great advantage.

Figure 10:
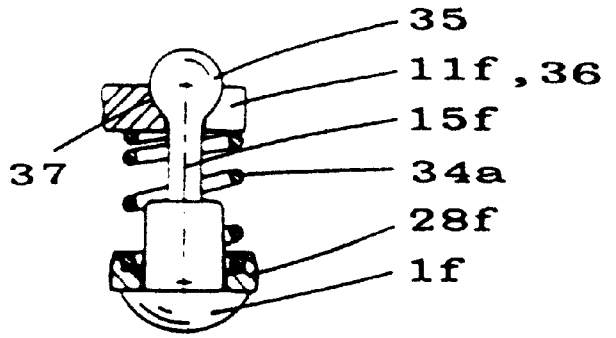
FIG. 10 shows an elevational view of a piston of FIG. 9 partly in section and enlarged so as to show detail.

The spring 34 also prevents a loose lateral flutter of the piston seal and major damage by foreign particles which may be stuck between a (mostly) softer piston seal and the cylinder by allowing a jamming or an instant stop of the movement between piston seal and cylinder. This time, if the friction in the cylinder is higher than the spring load, the piston seal moves reciprocally along the piston rod instead of along the cylinder. In other words, this machine can still run whilst one piston doesn't work anymore and its piston seal jams and doesn't move anymore in the cylinder in order to prevent a destruction of the cylinder wall. Practically the piston seal experiences an immediate high speed stop, if the friction exceeds a certain amount. It would never be possible to stop the entire machine in such a short time, in which a spring can react. With such a simple springy device, one gains enough time to stop the machine without major damage by a foreign particle. On the other hand, for instance, a gasoline pump or hydraulic motor of such a kind can work with the remaining cylinders until an airplane is landed. The spring 34 can also be used in a position of its shortest length without this extraordinary function. Additionally, the spring 34 can provide a radial preload for the plastic sealing element 28*e*. This is shown in FIG. 10 which is an enlargement of a piston 1*k* from FIG. 9. It is shown the sealing plane 57 and its surface-normal-vector 58, which is always in the longitudinal axis of the cylinder 2*e*. If the material of the piston seal 28*k* is soft, both its axial ring faces can be covered in metal. Then the piston seal 28*k* is a plastic metal compound structure (not shown).

Figure 11:
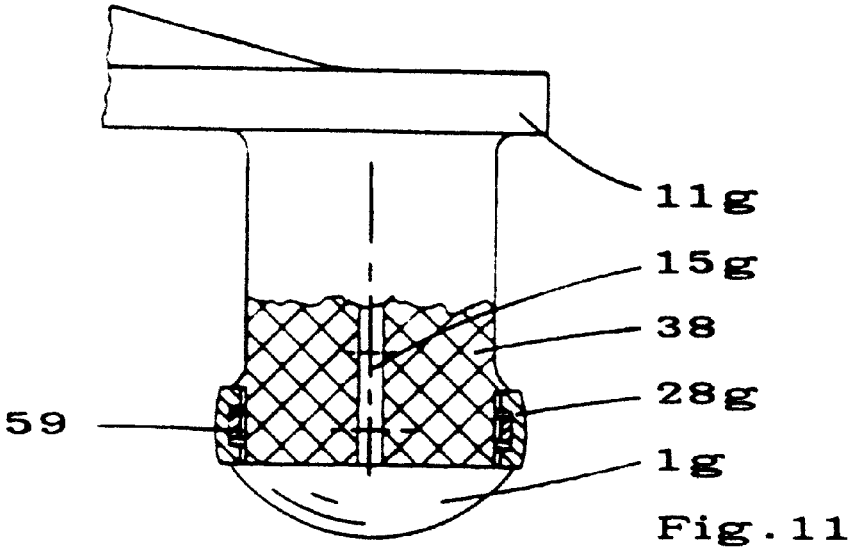
FIG. 11 is a partially sectional, elevational view of another piston attached to a piston carrier.

FIG. 11 shows another piston lg with a thin metallic piston rod 15*g* but with a large solid mantle 38 in rubber, sealingly attached to the piston 1*g* and to the piston carrier 11*g*, to release the piston rod 15*g* from the tractive force when the piston 1*g* is pulling. The piston seal 28*g* is spherical and radially preloaded by a flat, cylindrical ring spring 59.

Figure 12:
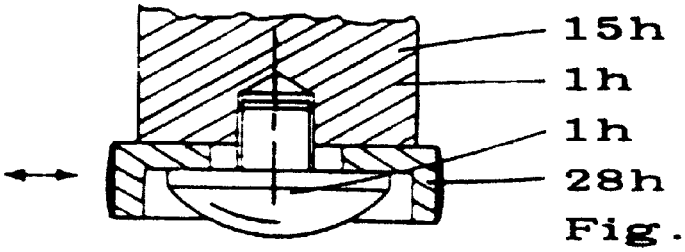
FIG. 12 shows a partially sectional, partial elevational view of a pusher piston with a piston seal.

FIG. 12 shows a "pusher piston" 1*h* of a pushing piston actuating mechanism. A piston seal 28*h* is shown here directed oppositely and axially secured on an end of a thick piston rod 15*h*, but radially movable within a radial clearance. It is shown here as a compound of metal and plastic with an exterior spherical part in softer sliding material. In this case, the housing of a pump with "pusher pistons" such as these must not be pressurized.

Figure 13:
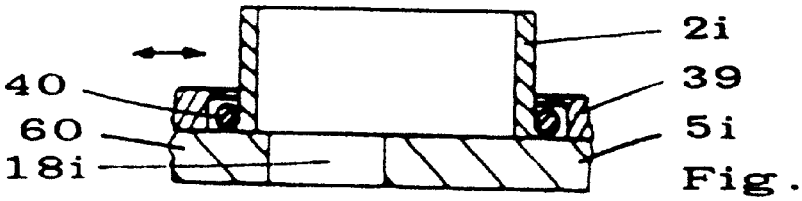
FIG. 13 shows a sectional, elevational view of a cylinder attached to a cylinder rotor.

FIG. 13 shows a slightly laterally shiftable cylinder bodies 2*i* on the cylinder rotor 11*i*, which is here actually only a disk 60 with the control channels 18i providing said uninterrupted annual control surface of the cylinder rotor. The frame 39 is mounted on top of the disk 60. The frame 39 has holes for the cylinders 2*i*, which are slightly larger as the cylinder bodies on their outside to provide space for a certain lateral mobility. An O-Ring 40 seals up the bottom of the cylinder 2*i* against the pressure in the housing and controls the lateral shifts of the cylinder bodies 2*i*.

A flexible cylinder (not shown), like a rubber tube, and a piston, like a hard ball, would also be possible, instead of shiftable cylinders or flexible piston rods, but only for relatively low pressure.

Figure 14:
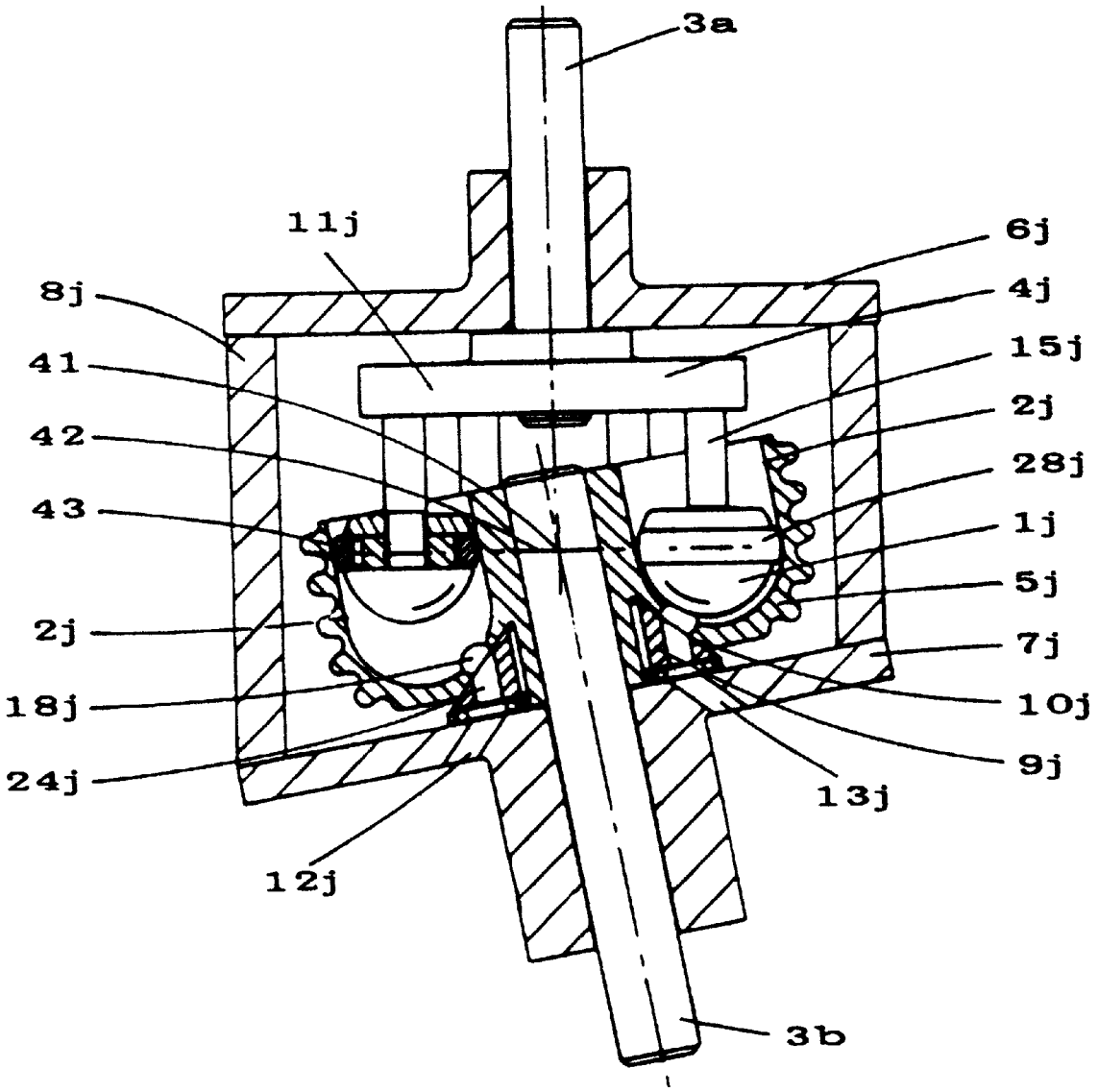
FIG. 14 shows a partially sectional, partial elevational view of an axial piston compressor or air-pressure motor.

FIG. 14 shows a 6-cylinder axial piston machine, particularly, for a compressor with two shafts. A piston rotor 4*j* is guided via a shaft 3*a* in an end plate 6*j*. A cylinder rotor 5*j* is guided via a shaft 3*b* in an end plate 7*j*. Both shafts 3*a* and 3*b* are slanted with respect to each other with an small inclination angle. The point of intersection 41 of both axes is in the middle plane 42 of the stroke motion, which is simultaneously the middle plane of all six spherical piston seals 28*j*. The piston rods 15*j* are stiff. A necessary shift will be executed between the piston seals 28*j* and the pistons 1*j* via a radial clearance 43. The pistons 1*j* are spherical and the bottoms of the cylinders 2*j* are spherical as well to avoid a dead volume. The channel control mechanism is located on the bottoms of the cylinders 2*j*, close to the shaft 3*b*. The control plate or ring 9j has a cone shaped control surface 10*j* and is elastically and sealingly fixed to the end plate 7*j*, because the stationary control ring 9*j* must follow the vibrations of the cylinder rotor 2*j* rather than the vibrations of the housing for a proper sealing contact. Control periods are predicted by sliding the cylinders 18*j* with the openings 18*j* upon the reniform or kidney-shaped stationary control channels 24*j* in the control ring 9*j* which are connected to the inlet/outlet ports 12*j* and 13*j*. The ports 12*j* and 13*j* that function as a inlet or outlet port, depends on whether the machine operates as a compressor or an air motor. Every desired internal compression is possible without using valves. A compressor of this type can work with water as well as oil as an operating or auxiliary fluid in the housing 46 for sealing and cooling; or may operate, as shown here, totally dry, that is, without any fluid. When required, the machine can also run with high speed. The housing 46 can be pressurized lower than the delivery pressure to minimize the thrust on both rotors 4*j* and 5*j*.

A "Displacement Turbine" may run one unit as a compressor to feed a combustion chamber followed by a second modified unit to run as a turbine. These units can be cooled with oil sprayed to the outside of the rotors. The control ring 9*j* with the cone shaped control surface 10*j* can easily be made in ceramic.

Figure 15:
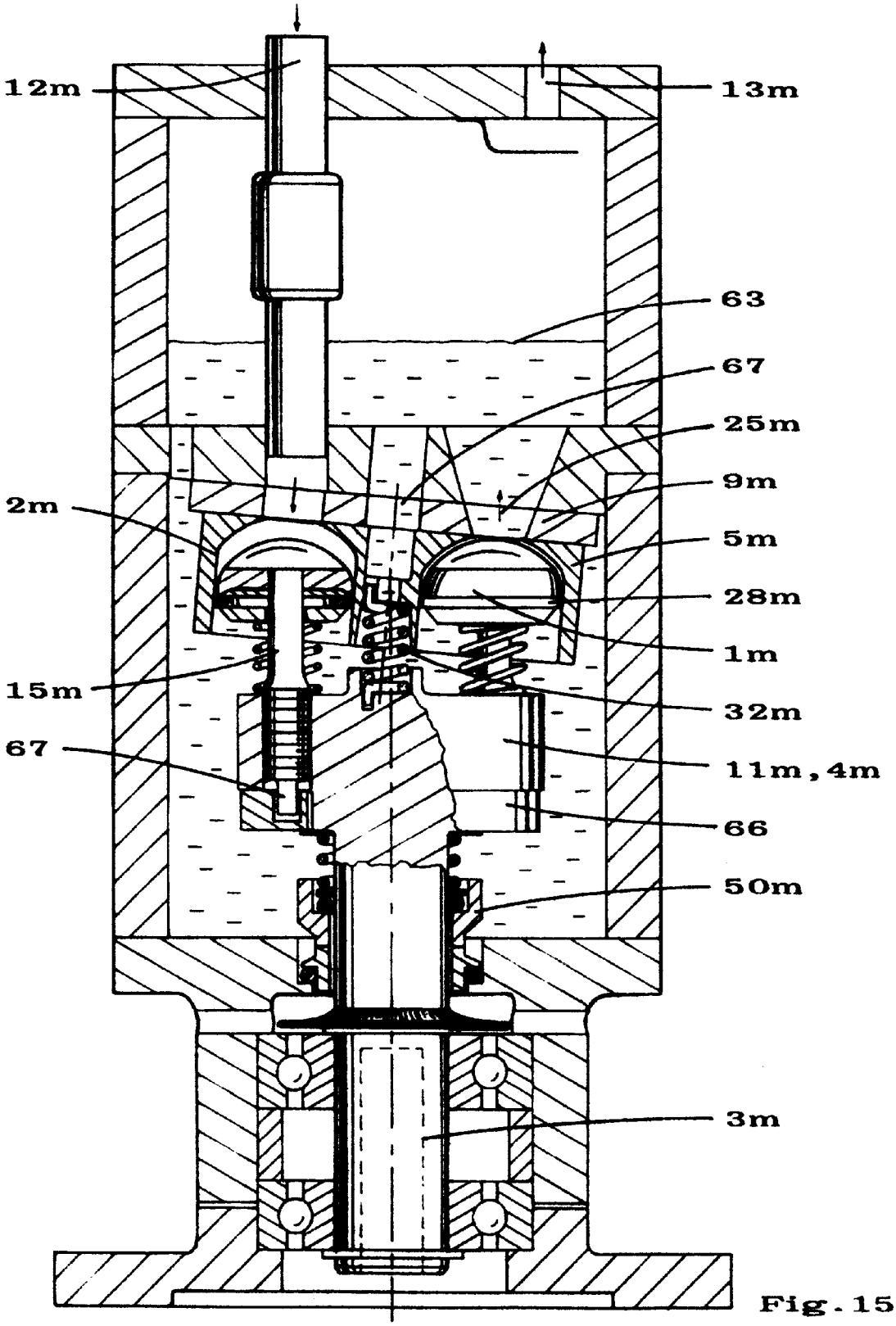
FIG. 15 shows a partially broken, partially sectional, plan view of a radial piston machine according to the invention.
Figure 16:
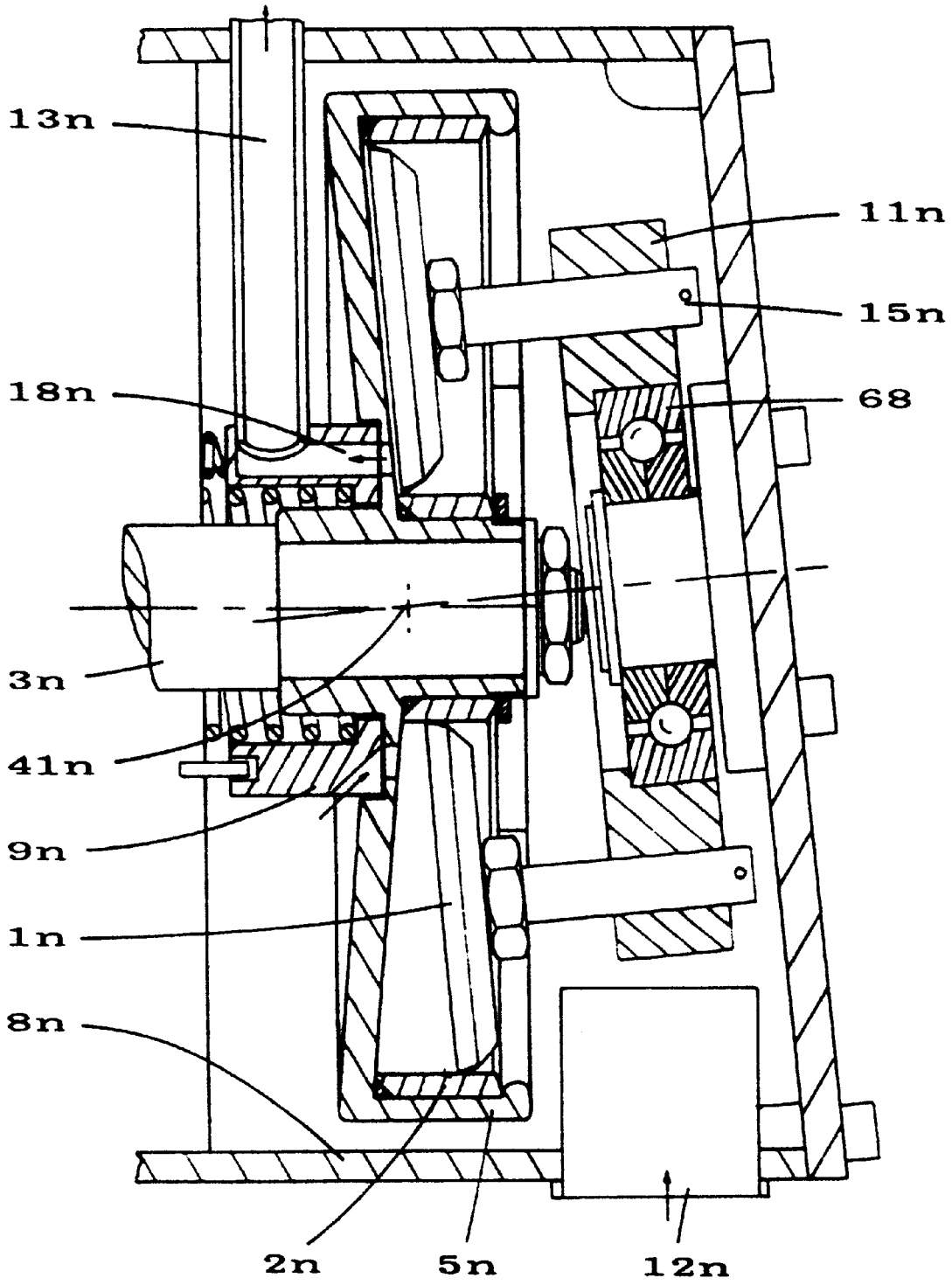
FIG. 16 shows a partially sectional view of a dry running compressor.
Figure 17A:
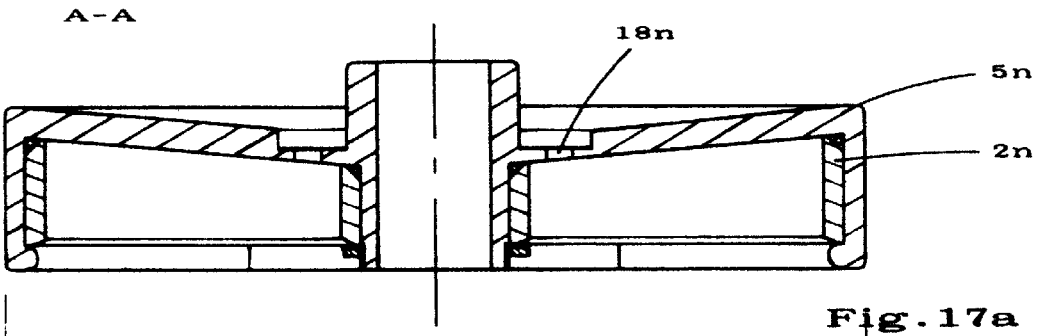
FIG. 17*a* shows a sectional view of a cylinger unit.
Figure 17B:
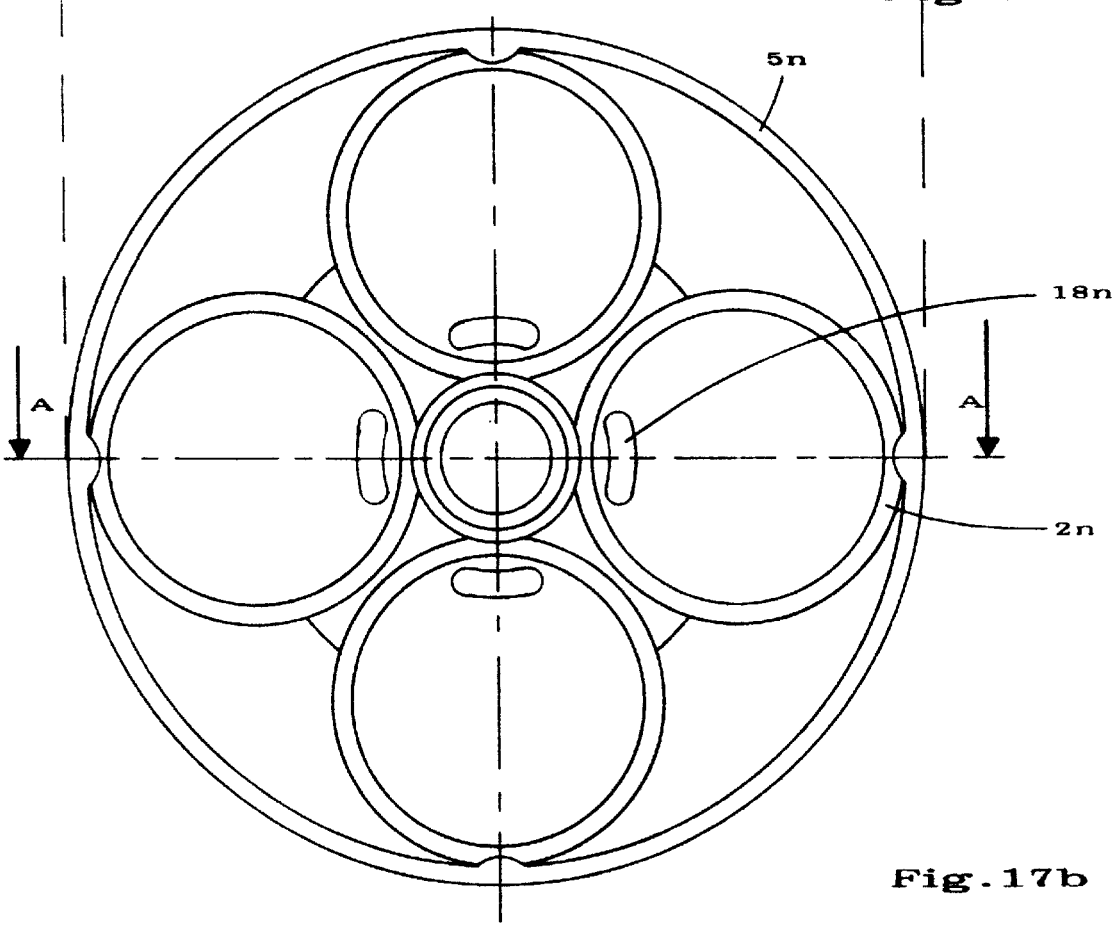
FIG. 17*b* shows a plan view of the same cylinder unit.
Figure 18A:
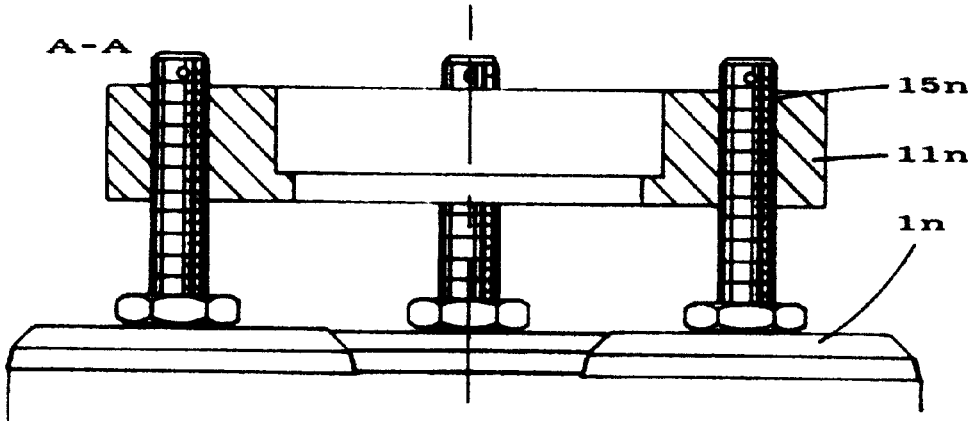
FIG. 18*a* shows a partial sectional view of a piston unit.
Figure 18B:
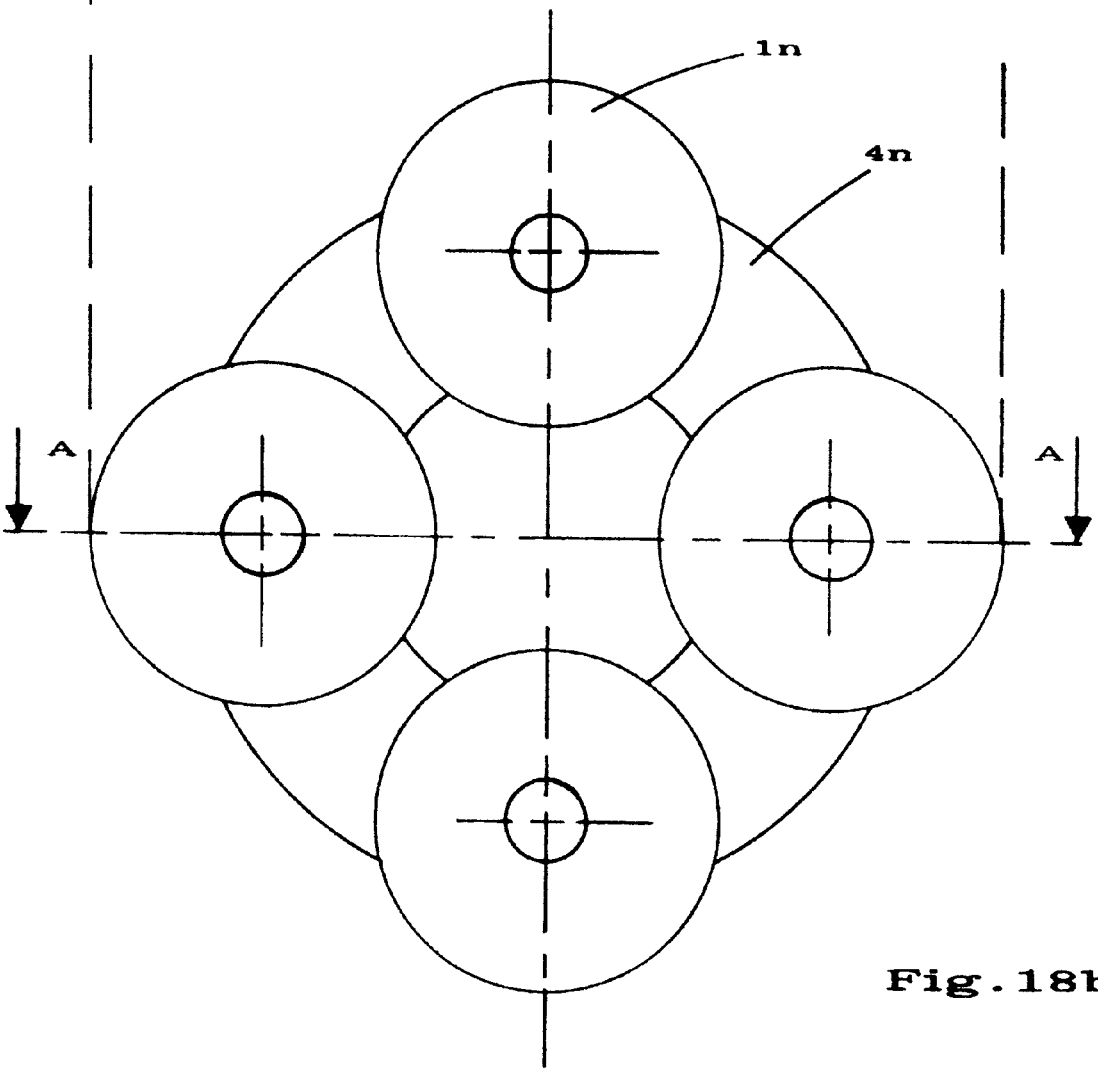
FIG. 18*b* shows a plan view of the same pistion unit.
Figure 19:
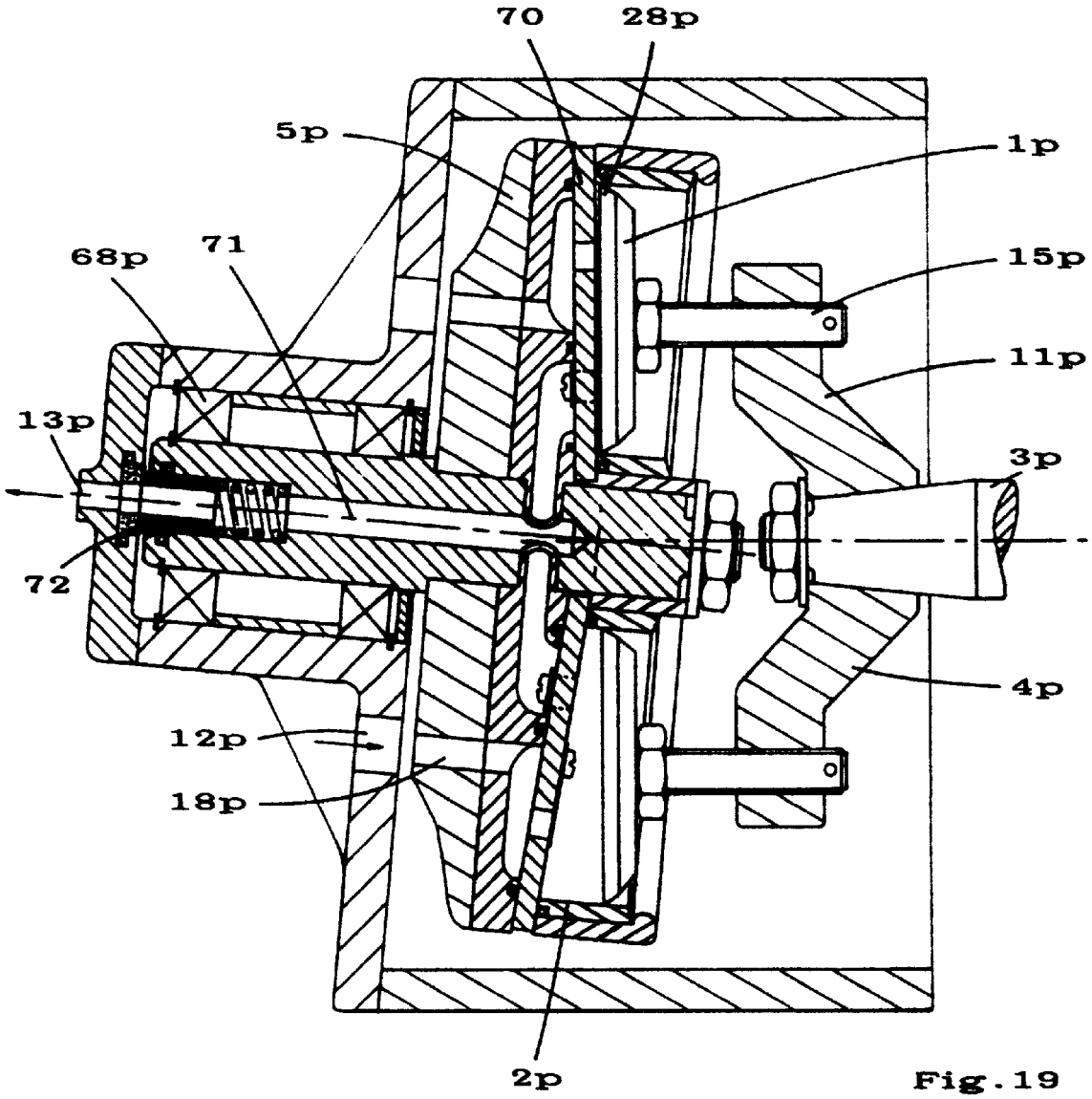
FIG. 19 shows a partially sectional view of another compressor.
Figure 20:
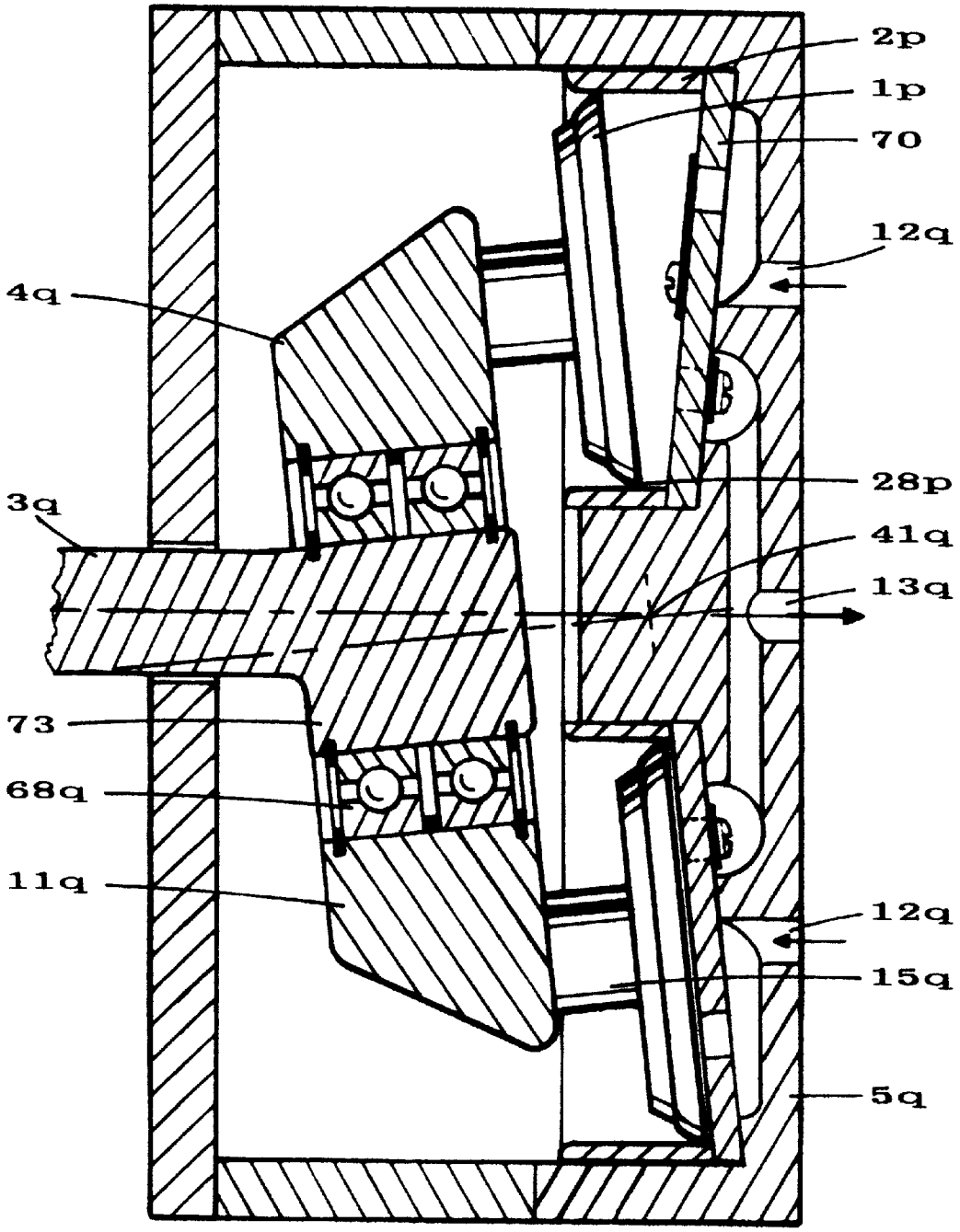
FIG. 20 shows a partially sectional view of another compressor.
Figure 21:
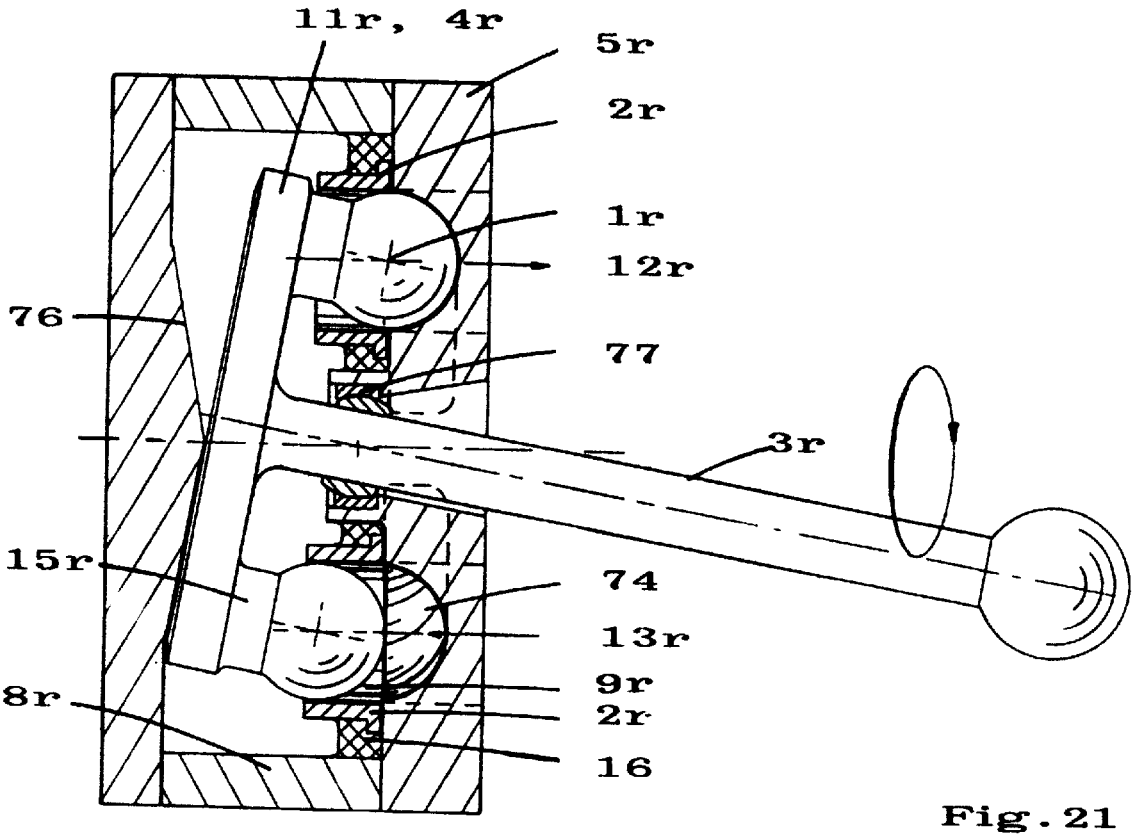
FIG. 21 shows a partially sectional view of a wobble pump.
Figure 22:
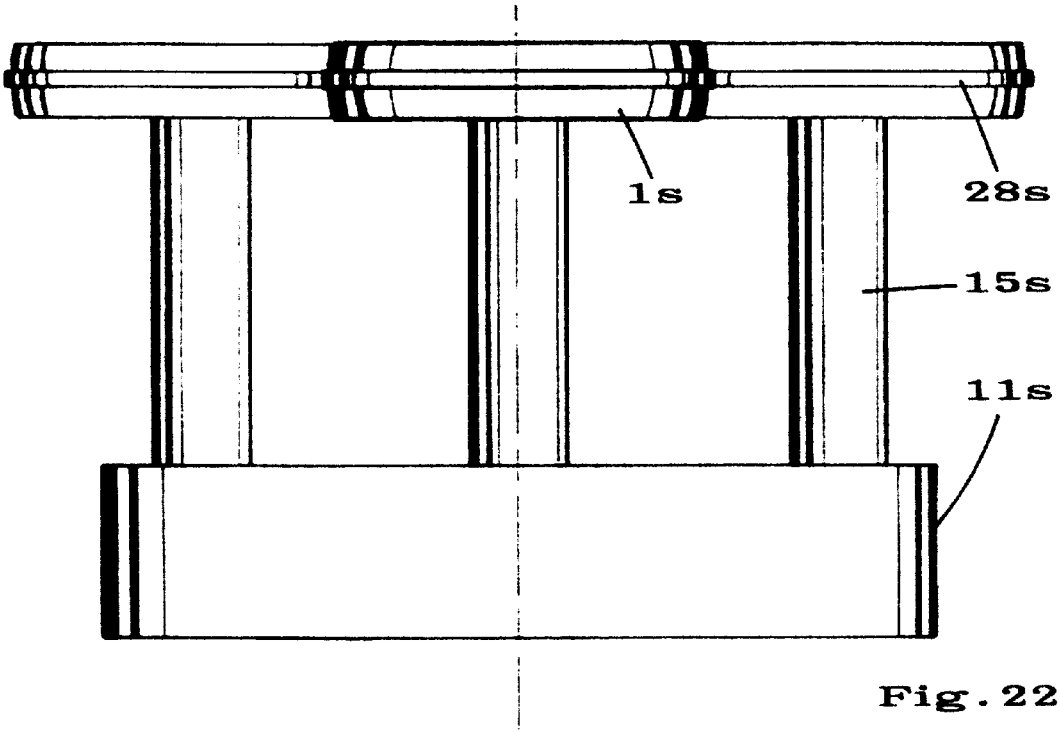
FIG. 22 shows a side view of a piston unit.
Figure 23:
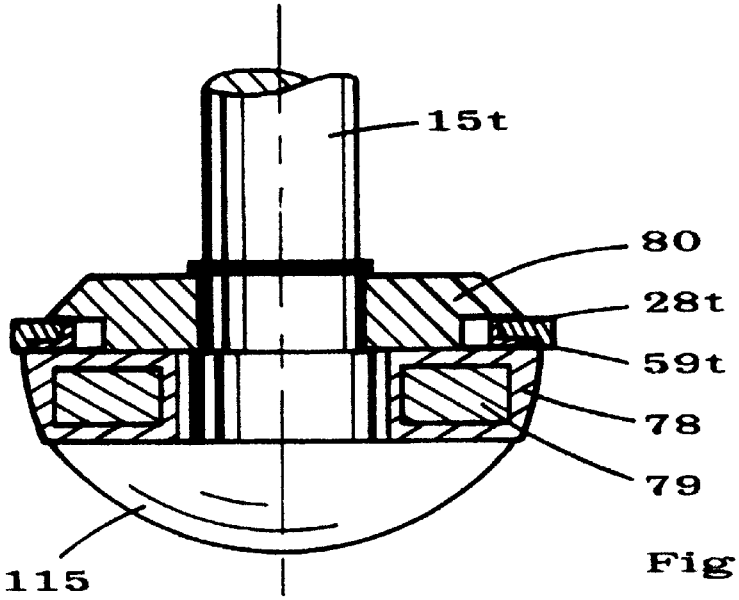
FIG. 23 shows a partially sectional view of a piston.
Figure 24:
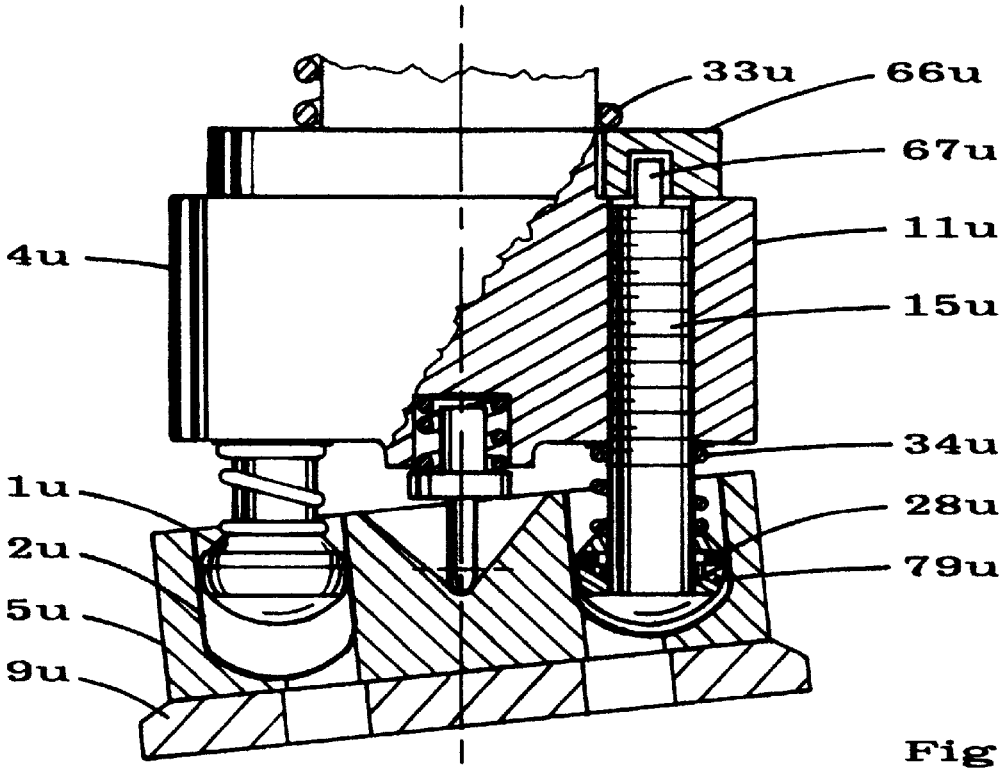
FIG. 24 shows a partially sectional view of a piston and cylinder unit.
Figure 25:
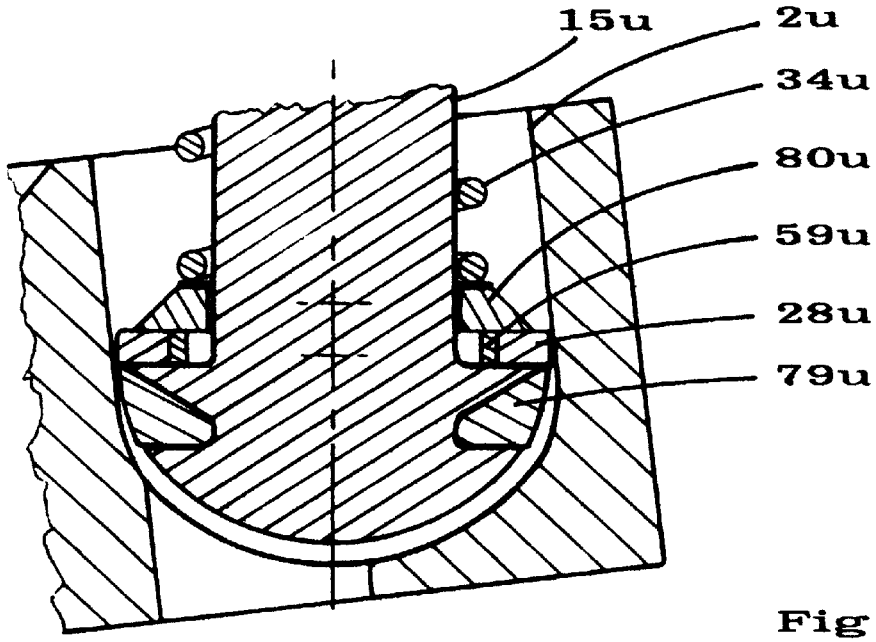
FIG. 25 shows a partially sectional view of another piston.
Figure 26:
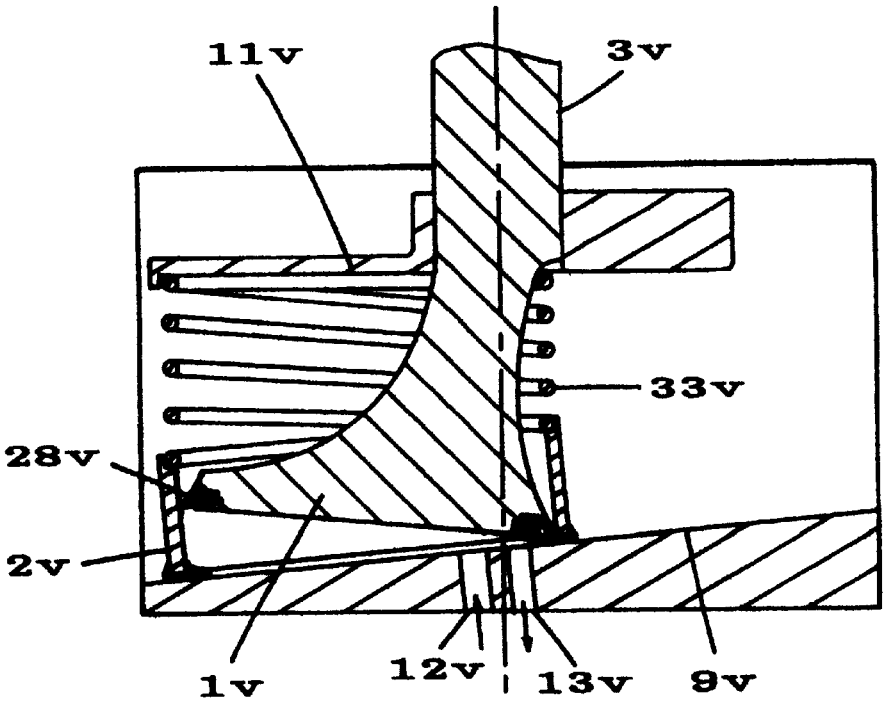
FIG. 26 shows a partially sectional view of an axial single piston machine.
Figure 27:
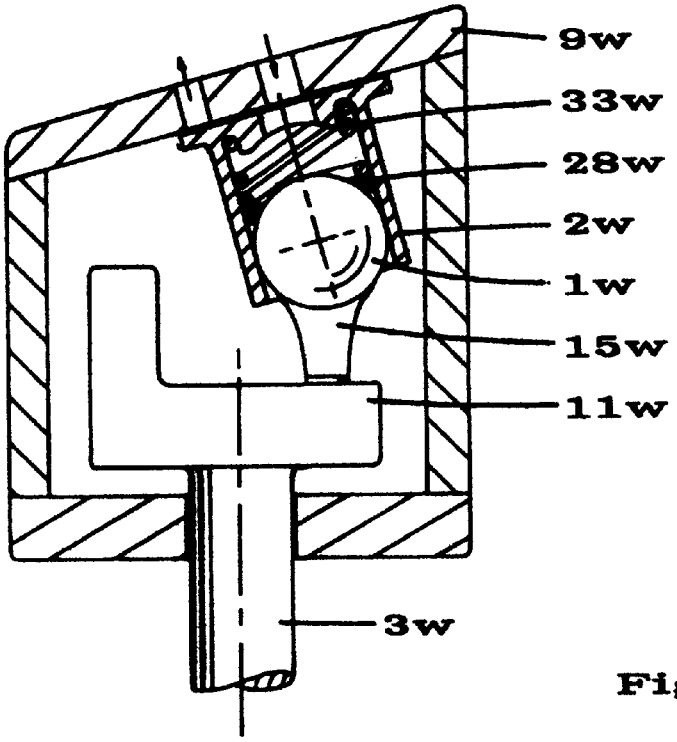
FIG. 27 shows a partially sectional view of another axial single piston machine.
Figure 28:
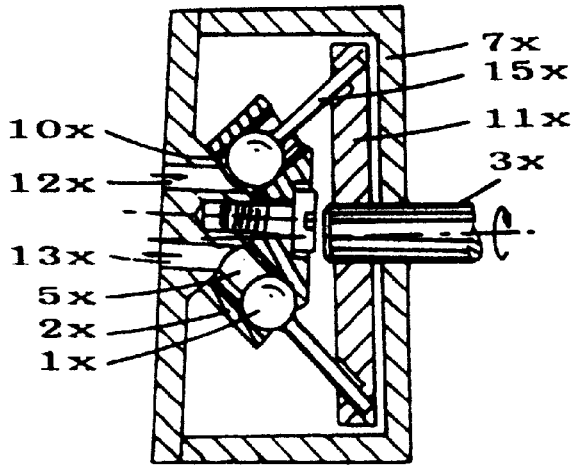
FIG. 28 shows a partially sectional view of a oblique-angled piston rods.
Figure 29:
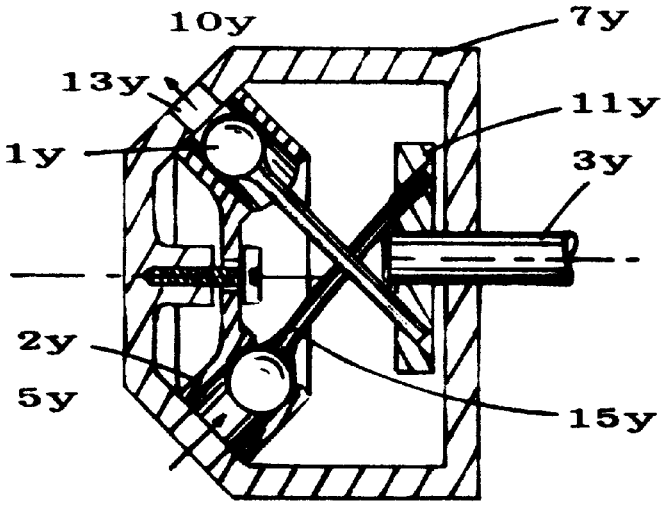
FIG. 29 shows a partially sectional view of another oblique- angled piston rods.
Figure 30:
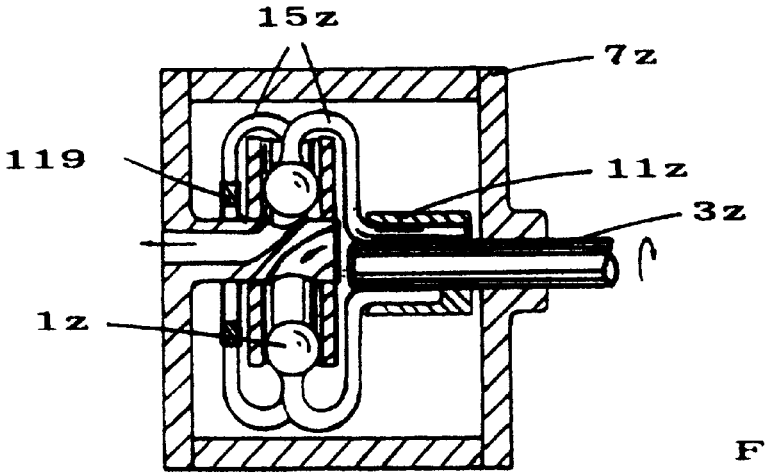
FIG. 30 shows a partially sectional view of a radial piston machine.
Figure 31:
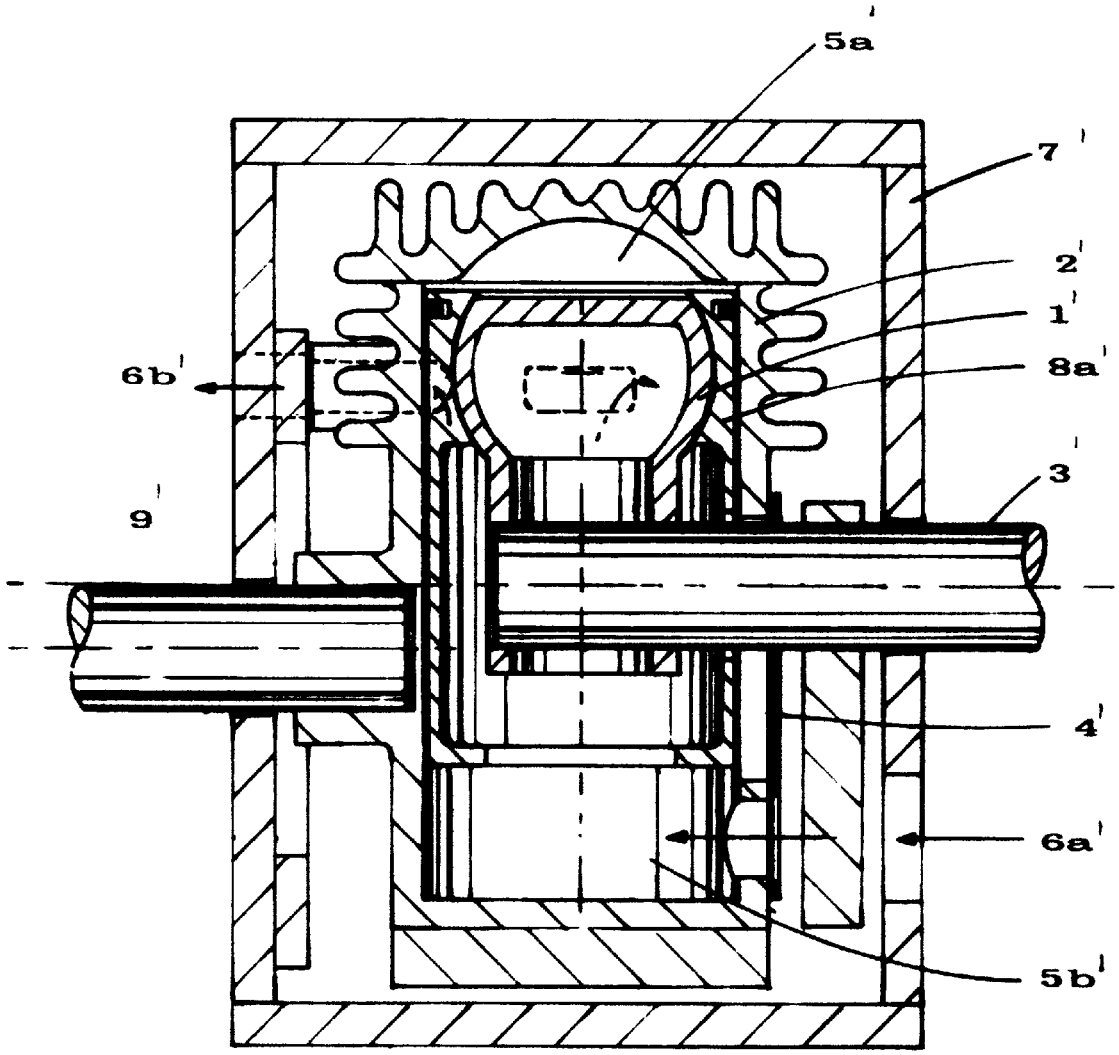
FIG. 31 shows a partially sectional view of a radial one-cylinder machine as a combustion engine.

FIG. 15 shows a 4-cylinder radial piston machine according to the invention. Pistons 1*k*, piston rods 15*k* and cylinders 2*k* are radially directed. The piston rotor 4*k* being slightly eccentrically to the cylinder rotor 5*k*. Both rotor axes 61 and 62 are shown parallel to one another and are spaced only a small distance apart (or one is slightly eccentric). Therefore, the length of the stroke motion is very short compared with the diameter of the rotors 4*k* and 5*k*, and the amplitude or elongation of lateral shifts of the piston seal 28*k* is much wider compared with the prementioned axial piston versions. But the piston seal 28*k* is not necessarily spherical. The piston seal 28*k* is held again in a longitudinal position on the piston 1*k* via the compression spring 34*k* and there additionally via radial force. In this case, the housing 8*k* is pressurized, ergo the pistons 1*k* and the piston rods 15*k* pull. The stationary control surface 10*k* shown here is cylindrical. The control channels 24*k* shown here are in the cylindrical housing 8*k* and are connected to the inlet/outlet port 12*k* and 13*k*.

The cylinder rotor is radially pressure balanced by varying the size of the control openings 18*k* of the cylinders 2*k*.

It is to be understood that the present invention is not limited to the embodiments described above, but encompasses any and all embodiments within the scope of the following claims.

I claim:

1. An axial piston machine comprising, a housing having a sidewall and first and second end walls, the first end wall having an inlet port and the second end wall having an opening through which a drive shaft extends into the housing, the side wall having an outlet port, the drive shaft having an end located within the housing, a stationary control plate mounted to an interior surface of the first end wall and having an inclined surface with a low pressure suction canal and a high pressure discharge canal on the inclined surface, there being a first passage in the control plate communicating the inlet port with the low pressure suction canal and a second passage in the control plate communicating the high pressure discharge canal with the interior of the housing, a piston rotor which is fixedly attached to the end of the drive shaft to move therewith, the piston rotor being a plate mounted perpendicularly to the drive shaft, the plate having plural threaded holes each having a central axis, each of the threaded holes receiving a piston rod having a threaded end, there being a clearance between the threaded end of the piston rod and the threaded hole which permits the piston rods to angularly shift with respect to the central axis of the threaded holes by a piston rod angle, the piston rotor plate and the inclined surface of the cylinder rotor means forming a rotor inclination angle of approximately 5 degrees, the piston rod angle being less than the rotor inclination angle, a hydrostatically balanced cylinder rotor means having the sums of the pressure forces from the interior of the housing and the high pressure and low pressure canals being balanced for enabling the cylinder rotor means to be hydrostatically balanced against the inclined surface of the stationary control plate, the cylinder rotor means having plural cylinders each receiving a corresponding piston therein, each piston has an annular sealing means between the piston and its corresponding cylinder, a circumferential piston balancing means being formed by the annular sealing means and the angularly shiftable pistons which eliminates the circumferential forces acting between the cylinders and the pistons, and a spring biased spacer pin having opposite ends of the pin received in a hole in the end of the drive shaft and in a spherical hole in the inclined surface of the cylinder rotor means, the spring biased pin exerting a force against the cylinder rotor means which biases the cylinder rotor means against the stationary control plate and allows the cylinder rotor means to lift off from the stationary control plate in response to forces within the high pressure discharge canal.

2. The axial piston machine of claim 1 further comprising, the annular sealing means being mounted to the piston.

3. The axial piston machine of claim 1 further comprising, the annular sealing means being mounted on the cylinder rotor means.

4. The axial piston machine of claim 2 wherein, the annular sealing means being pressure tight only when the piston is moving in the suction direction.

5. The axial piston machine of claim 2 wherein, the annular sealing means is spring biased.

* * * * *

UNITED STATES PATENT AND TRADEMARK OFFICE

CERTIFICATE OF CORRECTION

PATENT NO. : 6,152,014

DATED : November 28, 2000

INVENTOR(S) : Wolfhart Willimczik

It is certified that error appears in the above-identified patent and that said Letters Patent is hereby corrected as shown below:

On the Title Page, Item [75] the inventor's address should read:
------2106 72nd Street West
Bradenton, Florida 34209 ------

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*